US011019876B2

(12) United States Patent
Ausura

(10) Patent No.: US 11,019,876 B2
(45) Date of Patent: Jun. 1, 2021

(54) SKI BOOT DYNAMIC SUPPORT STRAP

(71) Applicant: ProAdvent LLC, Proctorsville, VT (US)

(72) Inventor: Adam V. Ausura, Proctorsville, VT (US)

(73) Assignee: ProAdvent, LLC, Proctorsville, VT (US)

( * ) Notice: Subject to any disclaimer, the term of this patent is extended or adjusted under 35 U.S.C. 154(b) by 0 days.

(21) Appl. No.: 16/405,821

(22) Filed: May 7, 2019

(65) Prior Publication Data

US 2019/0261728 A1 Aug. 29, 2019

Related U.S. Application Data

(62) Division of application No. 15/688,490, filed on Aug. 28, 2017, now Pat. No. 10,327,500.

(51) Int. Cl.

| | |
|---|---|
| ***A43B 5/04*** | (2006.01) |
| ***A43C 11/14*** | (2006.01) |
| ***A43C 11/22*** | (2006.01) |
| *A63C 10/06* | (2012.01) |

(52) U.S. Cl.

CPC ..... *A43B 5/0443* (2013.01); *A43B 5/0409* (2013.01); *A43B 5/0415* (2013.01); *A43B 5/0429* (2013.01); *A43C 11/14* (2013.01); *A43C 11/22* (2013.01); *A63C 10/06* (2013.01)

(58) Field of Classification Search

CPC ... A43B 5/0443; A43B 5/0409; A43B 5/0415; A43B 5/0429; A43C 11/14; A43C 11/22

See application file for complete search history.

(56) References Cited

U.S. PATENT DOCUMENTS

| | | | | |
|---|---|---|---|---|
| 3,224,118 | A | 12/1965 | Tenfel | |
| 3,239,953 | A | 3/1966 | Norton | |
| 3,475,835 | A | 11/1969 | Kovar | |
| 3,722,112 | A | 3/1973 | Morgan | |
| 3,798,799 | A * | 3/1974 | Hanson | A43D 999/00 36/117.6 |
| 3,848,347 | A | 11/1974 | Hanson | |

(Continued)

FOREIGN PATENT DOCUMENTS

| | | |
|---|---|---|
| CN | 204032526 | 12/2014 |
| CN | 206006130 | 3/2017 |

(Continued)

OTHER PUBLICATIONS

Chinese Office Action for CN 201810932697.4 dated Apr. 24, 2020.

(Continued)

*Primary Examiner* — Ted Kavanaugh
(74) *Attorney, Agent, or Firm* — Workman Nydegger

(57) ABSTRACT

In one example, a ski boot includes a plastic shell, a boot liner partly received within the plastic shell, and the boot liner including a tongue having an upper edge, and a dynamic support strap. The dynamic support strap includes a band connected to the plastic shell, and a restraint element connected to the band, the restraint element including a wall and a lip that together define an undercut area behind the wall, and the undercut area is configured and arranged to receive a portion of the upper edge of the tongue when the restraint element is operably positioned with respect to the tongue.

11 Claims, 23 Drawing Sheets

(56) References Cited

U.S. PATENT DOCUMENTS

| | | | | |
|---|---|---|---|---|
| D242,938 | S | 1/1977 | Famolare, Jr. | |
| 4,107,856 | A | 8/1978 | Bourque | |
| 4,121,359 | A | 10/1978 | Bertetto | |
| 4,258,482 | A | 3/1981 | Salomon | |
| 4,317,296 | A | 3/1982 | Hanson | |
| 4,624,063 | A | 11/1986 | Delery | |
| 4,662,082 | A | 5/1987 | Shabazz | |
| 4,696,117 | A | 9/1987 | Ottieri | |
| 4,756,099 | A | 7/1988 | Walkhoff | |
| 4,776,111 | A | 10/1988 | Crowley | |
| 4,914,839 | A | 4/1990 | Paris | |
| 5,007,186 | A | 4/1991 | Bischof | |
| 5,152,084 | A | 10/1992 | Bonnaventure | |
| D336,558 | S | 6/1993 | Escoffier | |
| D342,593 | S | 12/1993 | Balbinot | |
| D346,063 | S | 4/1994 | Clark | |
| D347,558 | S | 6/1994 | Alonzo | |
| 5,357,695 | A | 10/1994 | Lu | |
| D357,795 | S | 5/1995 | Crowley | |
| D365,437 | S | 12/1995 | Schaper | |
| 5,491,911 | A | 2/1996 | Chen | |
| 5,553,402 | A | 9/1996 | Marega | |
| 5,590,481 | A | 1/1997 | Vaccari | |
| D377,958 | S | 2/1997 | Chen | |
| D380,287 | S | 7/1997 | Chen | |
| 5,651,197 | A * | 7/1997 | James | A43B 7/1495 36/50.1 |
| D390,296 | S | 2/1998 | Lee | |
| 5,718,067 | A | 2/1998 | Ostinet | |
| D401,934 | S | 12/1998 | Wicks | |
| D404,895 | S | 2/1999 | Rosato | |
| 5,921,006 | A | 7/1999 | Vargas | |
| D413,197 | S | 8/1999 | Faye | |
| 6,026,594 | A | 2/2000 | Fougere | |
| D453,413 | S | 2/2002 | Tsujino | |
| 6,467,193 | B1 | 10/2002 | Okajima | |
| 6,557,865 | B1 | 5/2003 | Reuss et al. | |
| 6,655,052 | B2 | 12/2003 | Bruce | |
| 6,820,354 | B1 | 11/2004 | Zanatta | |
| 7,503,131 | B2 | 3/2009 | Nadel | |
| D603,155 | S | 11/2009 | Della Valle | |
| D615,285 | S | 5/2010 | Martin | |
| D634,523 | S | 3/2011 | Hirschfeld | |
| 7,946,061 | B2 | 5/2011 | Holzer | |
| D661,471 | S | 6/2012 | Parisotto | |
| 8,359,771 | B2 | 1/2013 | Holzer | |
| 8,418,381 | B2 | 4/2013 | Reagan | |
| 8,763,209 | B2 | 7/2014 | Kavarsky et al. | |
| 9,408,435 | B2 | 8/2016 | Labonte | |
| 9,538,805 | B2 | 1/2017 | Tronchin | |
| 9,549,592 | B2 | 1/2017 | Quagliotto | |
| 9,668,907 | B2 | 6/2017 | Romo | |
| 9,839,549 | B2 | 12/2017 | Walborn | |
| 10,327,500 | B2 * | 6/2019 | Ausura | A43B 5/0443 |
| 2007/0266595 | A1 | 11/2007 | Bird | |
| 2007/0271824 | A1 * | 11/2007 | Holzer | A43B 5/0433 36/87 |
| 2012/0117820 | A1 | 5/2012 | Atamian | |
| 2014/0338223 | A1 | 11/2014 | Adams | |
| 2015/0313318 | A1 | 11/2015 | Gibb | |
| 2016/0262487 | A1 | 9/2016 | Marechal | |

FOREIGN PATENT DOCUMENTS

| | | | |
|---|---|---|---|
| EP | 695515 | A2 * | 2/1996 |
| EP | 2591696 | | 5/2013 |
| EP | 2929794 | | 10/2015 |
| EP | 2929794 | A1 | 10/2015 |
| FR | 2876883 | B1 | 3/2007 |
| WO | 2012111033 | | 8/2012 |
| WO | 2016075621 | | 5/2016 |
| WO | 2016120175 | | 8/2016 |
| WO | 2016164102 | | 10/2016 |
| WO | WO 2016/164102 | | 10/2016 |

OTHER PUBLICATIONS

Taiwan Office Action for TW107129200 dated Feb. 27, 2020.

Chinese Office Action for CN 201810932697.4 dated Sep. 17, 2019.

U.S. Appl. No. 15/688,490, filed Aug. 28, 2017, Adam V. Ausura.

U.S. Appl. No. 29/615,319, filed Aug. 28, 2017, Adam V. Ausura.

http://www.nordicausa.com/products/gpx-130/, All Mountain / High Performance GPX 130, Nordica is a Division of Tecnica Group S.p.a. P.iva 00195810262 , Capitale Sociale Eur. 25.000.000,00—I.v. Rea di Treviso N. 78175 Societa Unipersonale, print out Aug 14, 2017.

http://www.nordicausa.com/products/speedmachine-130/, All Mountain / High Performance Speedmachine 130, Nordica is a Division of Tecnica Group S.p.a. P.iva 00195810262 , Capitale Sociale Eur. 25.000.000,00—I.v. Rea di Treviso N. 78175 Societa Unipersonale, print out Aug. 14, 2017.

Salomon X3 130 CS Ski Boots 2012, EVO, evo.com, sku# 51334, accessed: Apr. 2017.

Nordica Hell and Back H3 Ski Boot—Women's - Sale 2013/2014, Christy Sports, christysports.com, SKU: #0930367, accessed: Apr. 2017.

Salomon X-Pro 90 W Women's Boots 2016/2017, Golf & Ski Warehouse, golfskiwarehouse.com, accessed: Apr. 2017.

Lange World Cup 130 (HP Fit) Ski Boots 2007, U.S. Outdoor, usoutdoor.com, accessed: Apr. 2017.

European Search Report for European Patent Application 18191017.5 dated Jan. 17, 2019.

U.S. Appl. No. 15/688,490, dated Nov. 1, 2018, Restriction Requirement.

U.S. Appl. No. 29/615,319, dated Jan. 17, 2019, Notice of Allowance.

U.S. Appl. No. 15/688,490, dated Jan. 29, 2019, Office Action.

U.S. Appl. No. 15/688,490, dated Mar. 19, 2019, Notice of Allowance.

U.S. patent Application filed on May 7, 2019, by Ausura et al., U.S. Appl. No. 29/690,349.

* cited by examiner

SKI BOOT DYNAMIC SUPPORT STRAP

RELATED APPLICATIONS

This application is a divisional of, and hereby claims priority to, U.S. patent application Ser. No. 15/688,490, entitled SKI BOOT DYNAMIC SUPPORT STRAP, filed Aug. 28, 2017. All of the aforementioned applications are incorporated herein in their respective entireties by this reference.

FIELD OF THE INVENTION

Embodiments of the invention relate generally to sports equipment. More particularly, at least some embodiments of the invention relate to alpine or downhill ski boots and associated elements.

BACKGROUND

Modern ski boots generally perform well, but there remain some unresolved problems in this field. Particular problems relate to the tongue of the boot liner. In general, typical ski boots include some type of relatively hard plastic shell within which is fitted a cushioned, insulated boot liner that includes a padded tongue. When the boot liner is positioned in the shell, the tongue has a high degree of mobility. The tongue is able to move laterally, that is, side to side. As well, the upper portion of the tongue is able to move forward, upon flexing, toward the toe of the shell and releases rearward toward the heel of the shell. Finally, the tongue is able to move vertically up and down. In general, the mobility of the tongue enables a user to more easily insert his foot into the boot, and to remove his foot from the boot. As originally intended, the mobility of the tongue enables a given boot liner to accommodate any of a variety of different foot shapes.

While the mobility of the tongue is beneficial in some respects, it is problematic in others. For example, during normal usage it is common for the boot liner tongue of a ski boot to be pulled forward and up by the flexing nature of the boot. This movement of the tongue can occur every time the boot is flexed and, as a result, one or more of the intended characteristics of the boot, such as boot fit and comfort, ski control, and leverage, may be compromised.

To illustrate with one particular example, if the tongue is not retained in the proper vertical position and lateral position relative to the shin and lower leg of the user, it can be difficult for the user to maintain the correct positioning and orientation of his foot in the boot, since part or all of the shin and/or lower leg may not be properly restrained by the improperly positioned tongue. Thus, an improperly positioned tongue may allow the lower leg and/or foot of the user to move excessively within the boot liner and/or shell, resulting in inefficient energy transfer to the ski, and reduced control of the ski. Excessive movement of the foot inside the boot can also cause blisters and other discomfort.

Another problem with an improperly positioned tongue, such as a tongue that has moved upward out of position, is that, during normal use of the ski boot, there may be only partial and/or intermittent contact between the shin of the user and the tongue. As a result, the user may experience what is sometimes referred to as shin bang, which occurs when part of the shin moves freely back and forth within the boot liner and/or shell.

One approach to improving maintenance of the tongue position would be to simply tighten one or more of the boot buckles, such as the buckle, or buckles, on the upper cuff portion of the shell. However, while this approach may provide some marginal benefit, overly tight buckles reduce blood circulation, resulting in cold, painful feet.

Simply tightening one or more buckles in an attempt to secure the position of the tongue is insufficient for other reasons as well. For example, tightening of the boot buckles may reduce the extent to which the ankle portion of the boot is able to articulate, thus impairing the mobility of the boot and thereby compromising the ability of the boot to respond to dynamic conditions as the user skis.

In view of problems such as those noted above, it would be useful to provide a ski boot and ski boot liner configured so that undesirable motion of the tongue of the boot liner can be reduced, or eliminated. It would also be useful to be able to constrain vertical and forward motion of the tongue to within acceptable ranges of movement when the ski boot and ski boot liner are used together during normal use conditions.

BRIEF DESCRIPTION OF THE DRAWINGS

The appended drawings contain figures of example embodiments to further illustrate and clarify various aspects of the present invention. It will be appreciated that these drawings depict only example embodiments of the invention and are not intended to limit its scope. Aspects of the invention will be described and explained with additional specificity and detail through the use of the accompanying drawings in which.

DETAILED DESCRIPTION OF SOME EXAMPLE EMBODIMENTS

Figure 1:
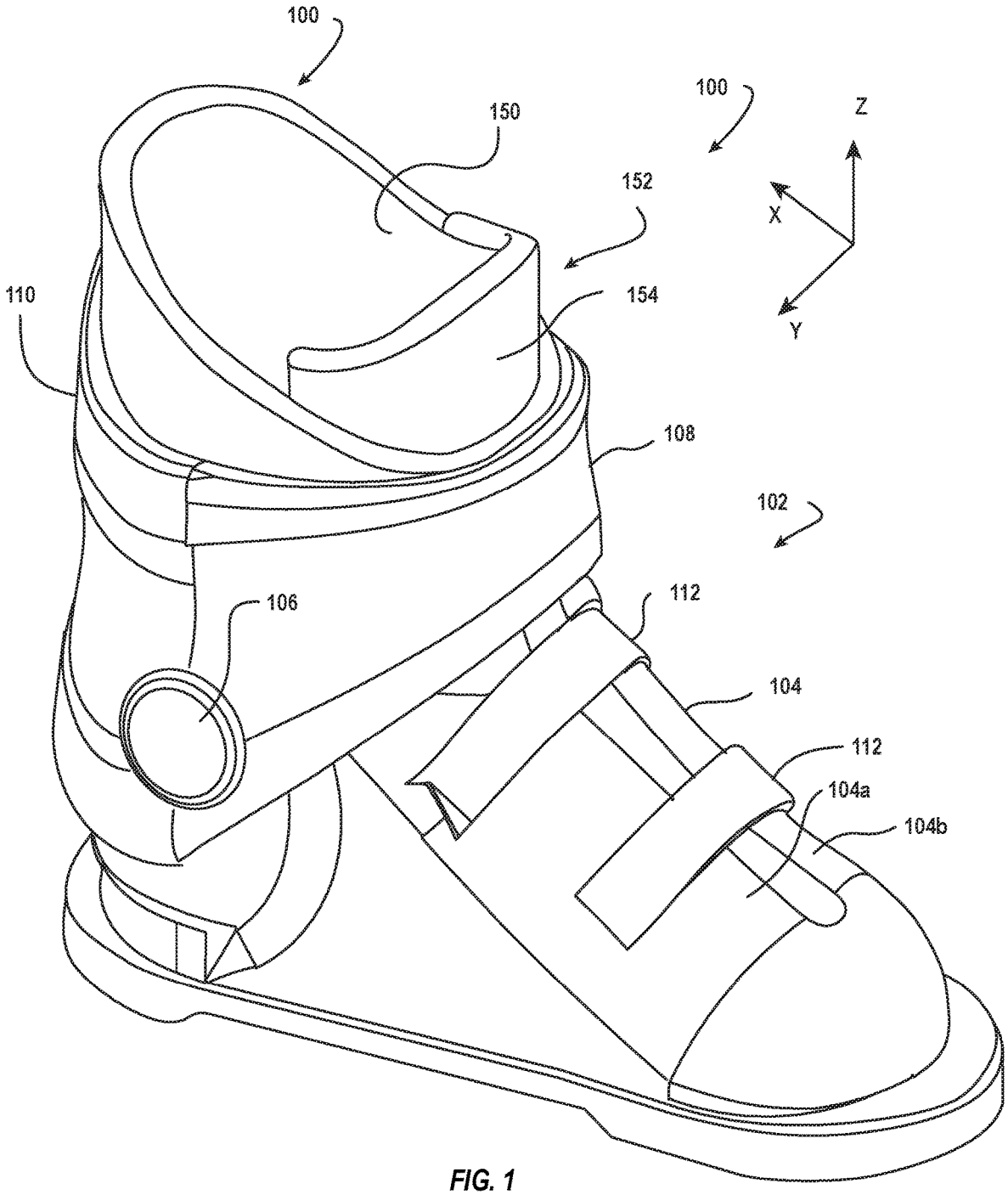
FIG. 1 is a front perspective view of a ski boot.

Embodiments of the invention relate generally to sports equipment. More particularly, at least some embodiments of the invention relate to ski boots and associated elements. In one example embodiment, a ski boot is provided that includes a hard, articulable shell, and a boot liner that is removably fitted within the shell and includes a movable tongue. The shell may include one or more buckles, as well as a cinching strap, sometimes referred to in the industry as a power strap, that collectively enable the user to tighten the boot around his leg and foot. The dynamic support strap includes a restraint element connected to a band, and the band is connected to the shell of the ski boot. The dynamic support strap is configured so that, in use, the restraint element engages the tongue and cooperates with the band to exert, by pushing and/or pulling, a downward retention force on the tongue, so as to limit upward, and/or forward and lateral motion of the tongue to a desired range.

Advantageously, one or more embodiments of the invention can help to ensure that the heel of the user is properly positioned as low as possible within the boot liner and the boot, and also to help ensure that the heel of the user is retained in the rearward-most possible position within the boot liner and the boot. The positioning of the heel in this way may provide, among other things, better control of the ski boot and ski, improved leverage over the ski boot tongue for easier flex of the ski boot, a better heel lock, more toe room, and an overall better feeling of fit.

Further advantages that may be provided by one or more embodiments of the invention include, but are not limited to, less need for over tightening upper cuff buckles, better blood flow from less tight buckles, a more easily articulable ankle from lessened tightness, an increase in calf room by providing a lower tongue position, and more extensive contact between the ski boot tongue and the shin of the user. As well, embodiments of the invention may provide an angularly oriented downward pressure to the top of the boot liner tongue, keeping the foot and heel of the user downward and rearward in the boot, and thereby assisting the skier to stay in an optimal stance. Moreover, the resilient nature of the restraint element and band, in cooperation with the tongue, can help to quickly return the foot and shin of the skier to the optimal stance after the foot and/or shin have temporarily moved out of position in response to movement of the skier over terrain.

A. General Aspects of Some Example Embodiments

While the discussion herein makes reference to ski boots, such as alpine ski boots or alpine touring (AT) ski boots for example, it should be understood that the scope of the invention is not limited to those types of ski boots, nor to ski boots. Rather, and more generally, the scope of the invention extends to any type of footwear where there is a need to maintain the tongue of the footwear in a desired position, or within a range of positions. For example, embodiments of the invention can also be employed with snowboard boots, snowboard bindings, snowshoes, and telemark boots. As used herein, an AT ski boot refers to a ski boot whose toe and heel can be locked into respective binding components, and which can be alternatively configured between a 'walk' mode and a 'ski' mode. In general, the 'walk' mode and the 'ski' mode are characterized by relatively different degrees of flex, where the AT boot is relatively easier to flex in the 'walk' mode than in the 'ski' mode. Embodiments of the invention may be especially useful when a skier is in the 'walk' mode with his AT boots and is skinning or otherwise moving uphill.

Any of a variety of different materials can be used in the construction of embodiments of the invention. The following discussion of materials is presented by way of example, and is not intended to limit the scope of the invention in any way. With reference first to the restraint element, flexible or rigid materials can be used in its construction. For example, some embodiments of the restraint element can be made of a flexible material such as rubber or flexible plastics. In some particular embodiments, the restraint element is made of silicon rubber. The silicon rubber restraint element can be made by a molding process, or other suitable process. In other embodiments, the restraint element can be machined from rubber sheet stock.

Other embodiments of the restraint element can be made of elastomers, such as thermosets or thermoplastics. In some particular embodiments, polymers, such as polyurethanes for example, can be used for the material of the restraint element. Such polymers include thermosetting polymers and thermoplastic polymers. Any of the flexible materials disclosed herein may be elastically deformable, so as to retain their shape after temporarily deforming to accommodate motion of the ski boot, ski boot liner, and/or the user. The responsiveness of embodiments of the invention can be further enhanced with the use of a band that includes an elastic portion, although that is not necessarily required.

In yet other embodiments, rigid materials can be used in the construction of the restraint element. Thus, some embodiments of the restraint element are made of rigid plastic formed by injection molding or any other suitable process. Other rigid materials such as metals, composites, carbon, or fiberglass, for example, could be used in the construction of the restraint element. As well, the restraint element can be made of a combination of multiple different rigid materials including the examples herein, a combination of multiple different flexible materials including the examples herein, or a combination of one or more rigid materials and one or more flexible materials.

As suggested above, various processes can be used to create embodiments of the restraint element. Such processes include, but are not limited to, vulcanizing, injection molding, other types of molding, thermoforming, machining, casting, pre-impregnated (pre-preg) processes involving the use of composite fibers and a thermoset polymer matrix material such as an epoxy.

In terms of its finish, one, some, or all, surfaces of the restraint element may be relatively smooth, or may be textured. As well, one, some or all, surfaces of the restraint element may include one or more protruding elements, for example, to enable the restraint element to better grip a portion of the tongue of a boot liner.

With reference now to the band portion of embodiments of the dynamic support strap, any of a variety of materials can be used. In general, the band can be elastic, or inelastic, or may include both elastic portions and inelastic portions. In some embodiments, the band is elastic along most, or all, of its length. As used herein, elastic refers to materials that temporarily deform under the influence of an applied force and, upon removal of the force, return to their initial configuration. The band can be made of nylon webbing and/or other materials and forms, and may include a closure, one example of which comprises respective portions of a hook-and-loop material, examples of which are sold under the VELCRO® trademark. In another example, the closure takes the form of a spring-loaded cleat. More generally, any other fastening mechanism or closure can be used with the band. Further details concerning example embodiments of a booster strap are set forth below.

B. Some Example Embodiments of a Dynamic Support Strap

Turning now to FIG. 1, details are provided concerning some example embodiments of a dynamic support strap and associated ski boot. In general, a ski boot 100 is indicated. The ski boot 100 can be an alpine ski boot, alpine touring (AT) ski boot, telemark ski boot, or any other type of ski boot. The ski boot 100 includes a hard shell 102 comprising a lower portion 104 to which is rotatably connected, by way of a hinge 106, an upper portion 108. The upper portion 108 includes a cuff 110. Each of the lower portion 104 and the upper portion 108 may be configured with a pair of movable portions, such as example portions 104*a* and 104*b* in the case of the lower portion 104, whose positions can be adjusted relative to each other to tighten and loosen the ski boot 100 on the foot of the user. In particular, one or more buckles 112 may be connected to the lower portion 104 and one or more buckles (not shown) may be connected to the upper portion 108. These buckles, including buckles 112, can be used to adjust the positions of the movable portions of 104 and 108 to tighten and loosen the ski boot 100 as needed by the user.

With continued reference to FIG. 1, the ski boot 100 may include a cushioned boot liner 150 removably positioned within the hard shell 102. In general, the boot liner 150 is made of a flexible material so as to generally conform to the size and shape of the foot of the user, and to accommodate some movement of the foot as the user skis. The boot liner 150 includes a movable tongue 152 having an extended portion 154 that extends a distance upward beyond the top edge of the cuff 110. Among other things, the extended portion 154 of the tongue 152 provides support to the shin of the user, while also assisting with power transmission from the ski boot 100 to the ski (not shown) while the user is skiing.

Figure 2A:
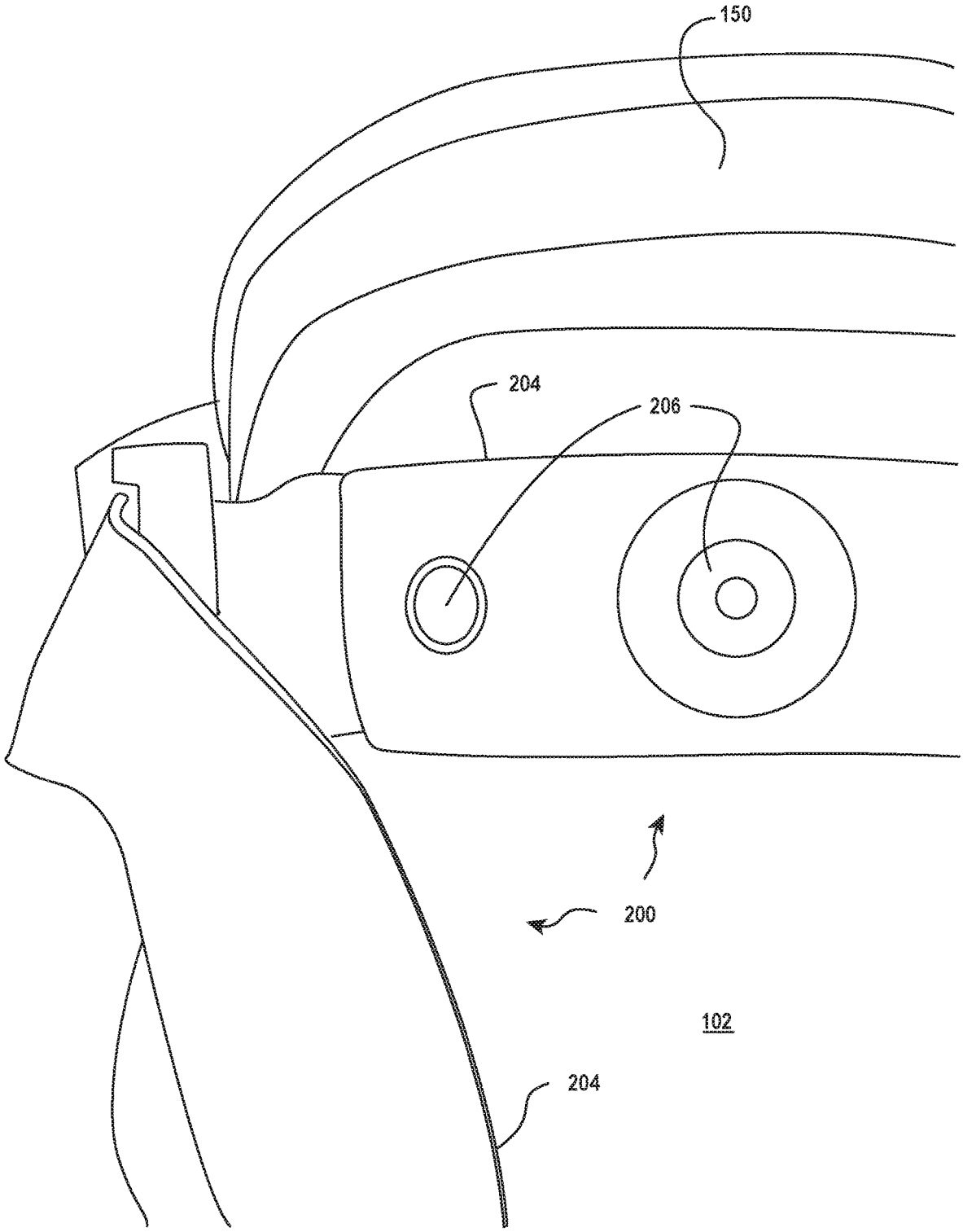
FIGS. 2*a*-2*d* disclose aspects of various example embodiments of a ski boot booster strap.
Figure 2B:
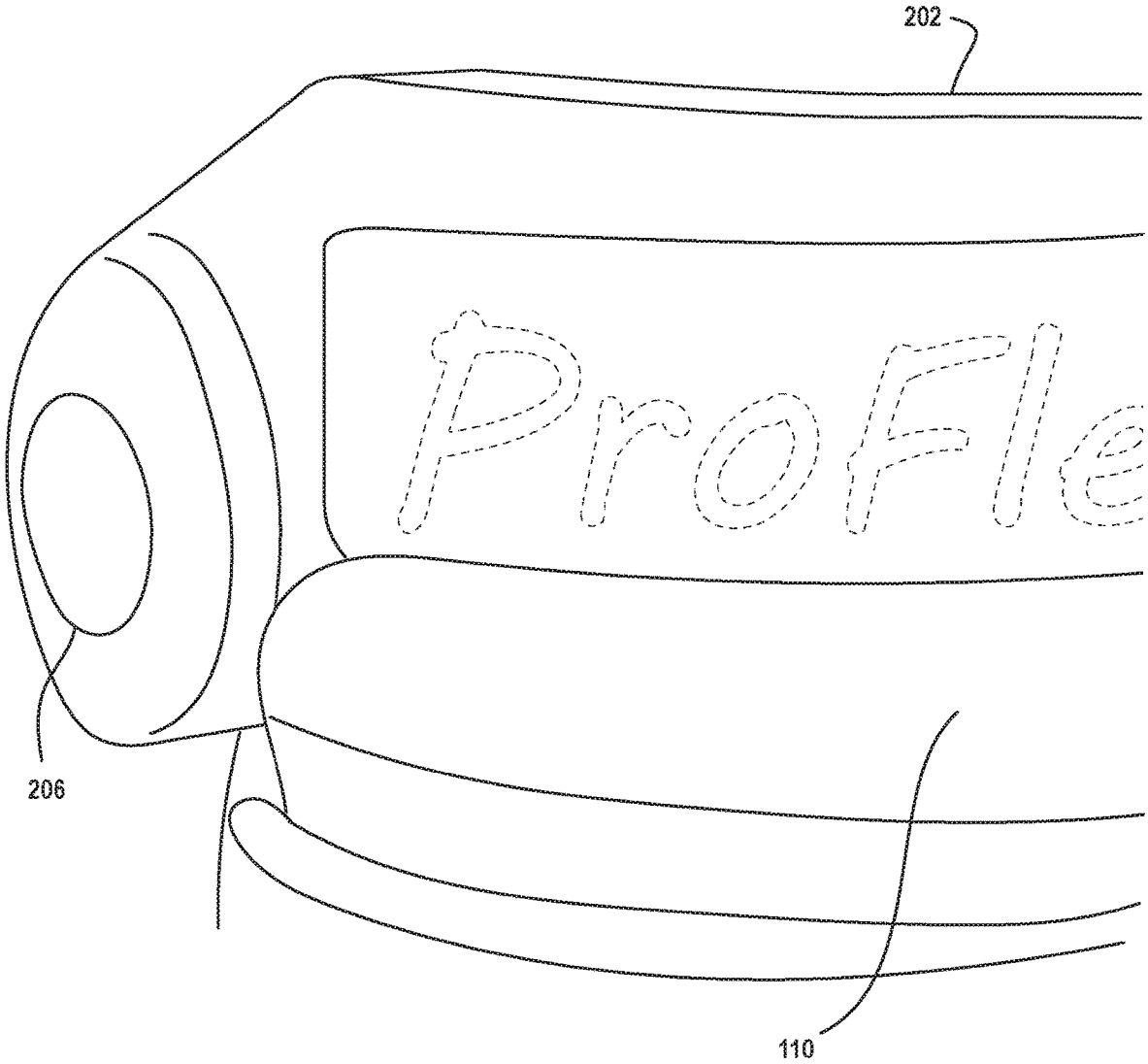
Figure 2C:
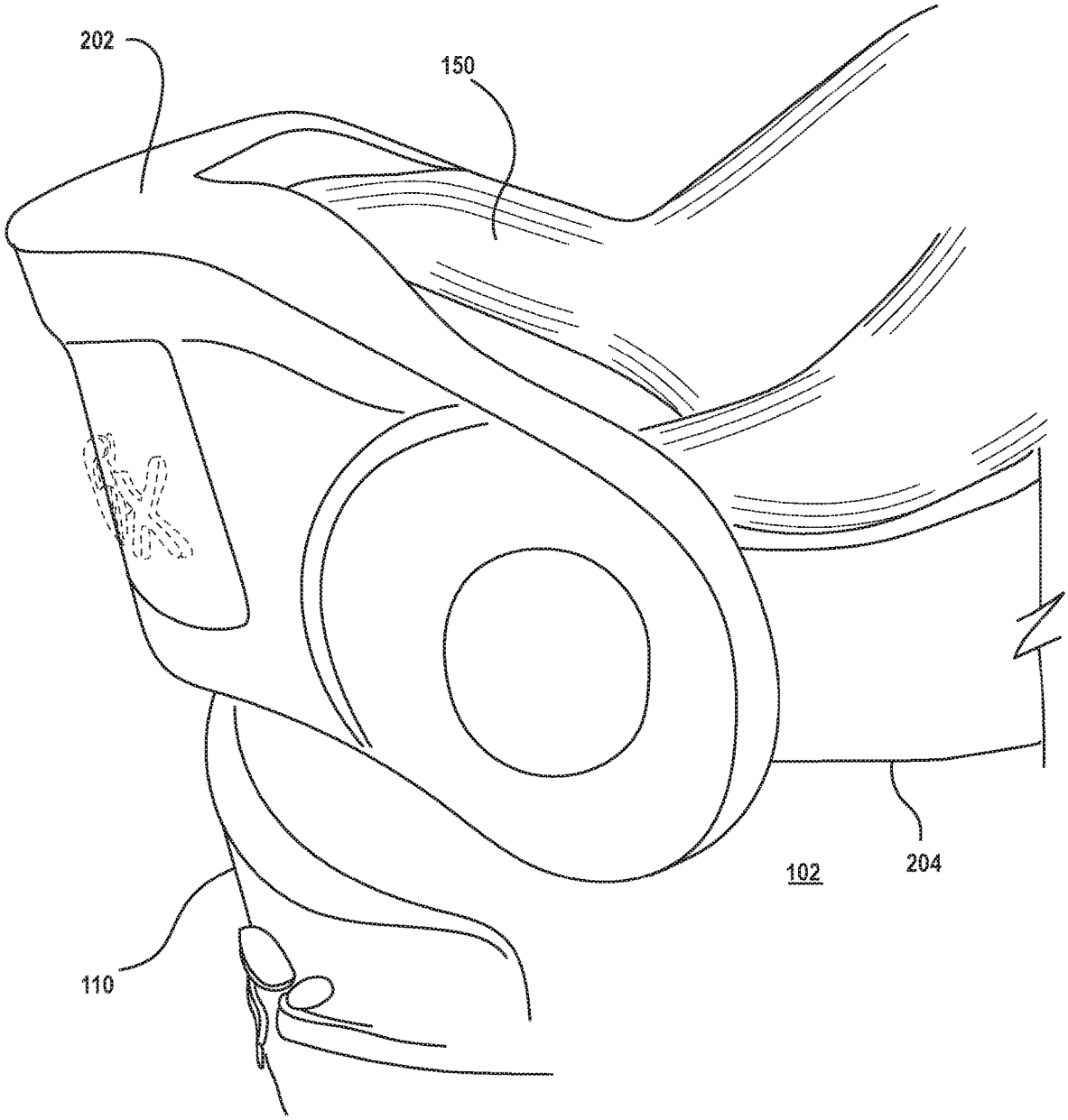

With reference now to FIGS. 2*a*-2*c*, the ski boot 100 further includes a dynamic support strap 200. The booster strap 200 includes a restraint element 202 that is connected, either permanently or releasably, to a band 204, and the band 204 is connected, either permanently or releasably, to the shell 102. The band 204 can include an elastic portion that enables it to stretch, and may or may not have an adjustable length.

The connection of the restraint element 202 to the band 204, and/or the connection of the band 204 to the shell 102 can be implemented temporarily or permanently in a variety of ways including permanently by way of fasteners 206 such as screws, bolts, rivets or pins, or temporarily by way of snaps that can be snapped and unsnapped, for example. Thus, in at least some embodiments, the restraint element 202 is rotatably connected to the band 204 and/or the band 204 is rotatably connected to the shell 102. One or both of the aforementioned rotatable connections may enable the restraint element 202 and/or band 204 to respond to changes in the orientation of the boot liner 150 and/or shell 102 as the user is skiing, while maintaining the tongue 152 in a desired position and orientation.

In some embodiments, the dynamic support strap 200 can be used in place of the so-called 'power strap' that is included on some ski boots. Thus, the dynamic support strap 200 may take the form of an after-market modification to a ski boot. That is, the user can replace the original power strap on the ski boot with the dynamic support strap 200. In this way, the user can obtain the functionality of the dynamic support strap 200 without having to purchase a new pair of ski boots. In still other embodiments, an existing power strap can be modified to include a restraint element 202, such as by attaching the restraint element 202 to the existing power strap.

Figure 2D:
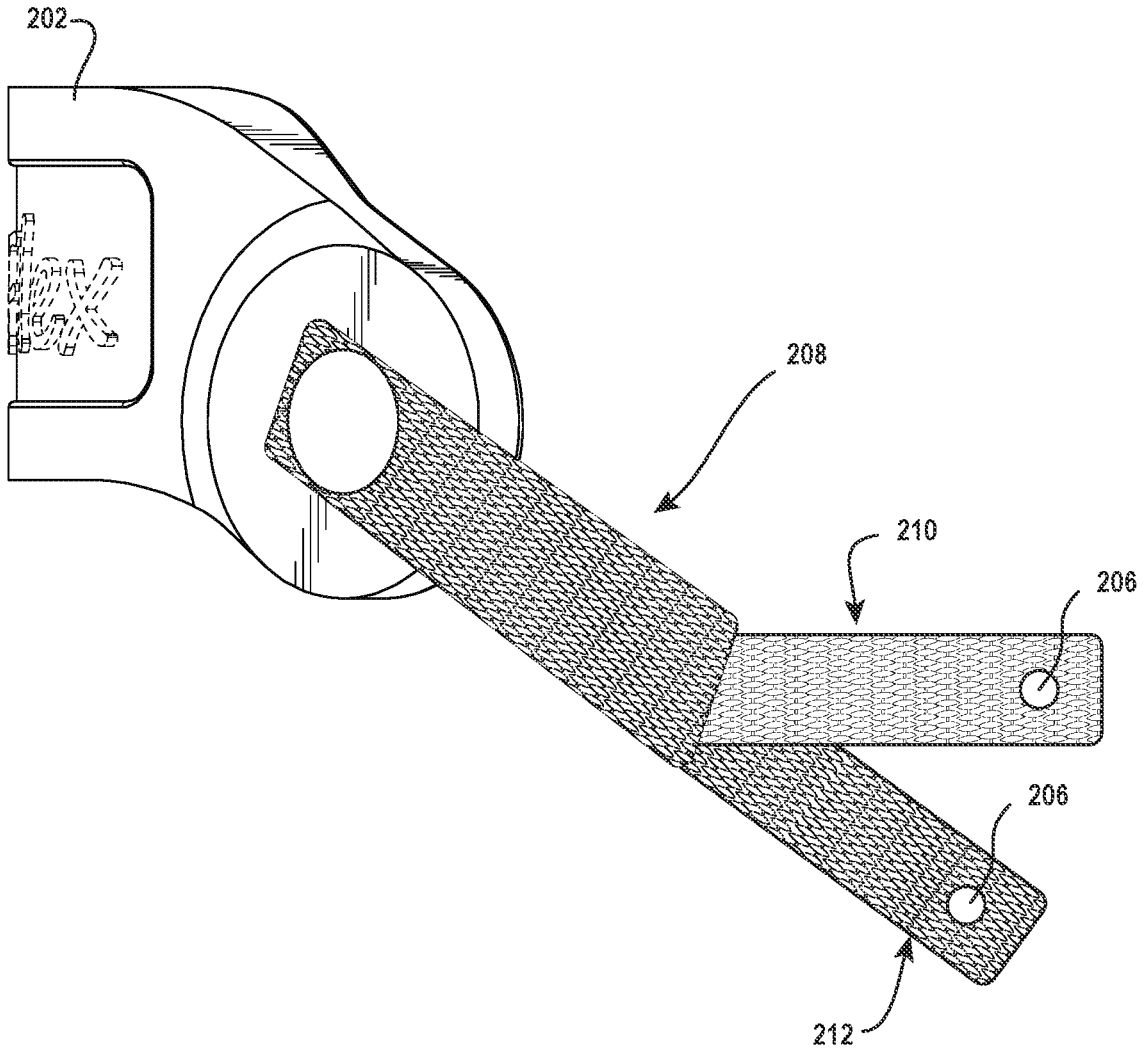

As shown in FIG. 2*d*, an alternative embodiment of a band 208 may be employed that connects to the restraint element 202 but includes two separate straps 210 and 212 that connect to the ski boot with fasteners 206. One or both of the straps 210 and 212 can have an adjustable length, and the straps 210 and 212 can be rotatably attached to the ski boot. The use of two straps 210 and 212 may provide an additional measure of control over the movement and retention of the restraint element 202.

In general, the restraint element 202 and band 204 are configured and arranged so that, in use, the restraint element 202 may be positioned above an upper edge of the front part of the cuff 110 to engage at least part of the upper edge of the extended portion 154 of the tongue 152, as shown in FIG. 2*c*. Alternatively, and as shown in FIG. 2*b*, at least part of the restraint element 202 can be positioned immediately behind a front part of the cuff 110 and engages at least part of the upper edge of the extended portion 154 of the tongue 152.

In either case, when the band 204 is tightened and/or otherwise manipulated by the user so as to transmit a force to the restraint element 202, the restraint element 202 can, in response to such manipulation of the band 204, exert a downward oriented force, that is, a force directed toward the sole of the ski boot 100, and/or a rearward oriented force, that is, a force directed toward the back of the ski boot 100, on the extended portion 154 of the tongue 152. In this way, the dynamic support strap 200 is able to maintain the tongue 152 in a desired position and orientation, or within a desired range of positions and orientations, while the user is skiing. Thus, the restraint element 202, either alone or in combination with the band 204, comprises an example structural implementation of a means for exerting a retention force, which can have any combination of downward (Z-axis), lateral (Y-axis) and/or rearward (X-axis) force components, on the tongue 152. Any other structure(s) of comparable functionality to the restraint element 202, whether alone or in combination with the band 204, could alternatively be used.

C. Example Embodiments of a Restraint Element

With reference now to FIGS. 3*a*-3*j*, details are provided concerning an example embodiment of a restraint element 300. In general, the restraint element 300 can have a unified single piece construction made of a single piece of material. The restraint element 300 can have a generally curved body 302 that describes an arc when the restraint element 300 is viewed from the top or bottom. Such an arc may be about 90 degrees, but that is not required, and arcs of larger, or smaller, sizes could alternatively be used. In general, the curve, or other shape, of the body 302 may generally conform to the shape of a ski boot tongue and/or to the shape of the front of a ski boot cuff. The curved shape may be useful in helping to ensure substantial contact between the restraint element and the tongue of the boot liner. The curved shape also reduces the likelihood that the restraint element will get caught or hung up, such as on the clothing of the user. Finally, some embodiments of the example restraint element 300 can be substantially symmetric about an axis, such as the Z-axis as shown in Figure RR, although symmetry is not required.

As shown in FIGS. 3*a*-3*j*, the restraint element 300 can include a wall 304 which is oriented generally vertically in the Figures. The wall 304 has a front surface 304*a* which faces toward the front of the ski boot, and a rear surface 304*b* which is configured to engage a portion of the tongue of a boot liner, particularly, an outer surface of an upper portion of the tongue. The wall 304 may be relatively higher in its center, having a height H1, and relatively lower at its sides, having a height H2 that is less than H1. As well, the side portions of the wall 304 may slope downward, as shown. In general, the wall 304 may have a height and arc length adequate to ensure substantial contact between the front surface 304*a* of the wall 304 and an outer surface of the upper portion of the tongue of a boot liner.

The wall 304 may terminate, at each end, in a connection point 306 that includes an inner surface 306*a* and outer surface 306*b*. In general, the connection points 306 enable connection of the restraint element 300 to a band or other device. For example, where the connection points 306 define an opening 306*c*, a fastener can be passed into the opening 306 so as to enable the restraint element 300 to be releasably, or permanently, connected to a band. The connection points 306 can be configured so that the inner surface 306*a* is depressed slightly below the inner surface 304*b* of the wall 304, and the outer surface 306*b* of the connection points 306 may extend slightly beyond the outer surface 304*a* of the wall 304, although neither the aforementioned configuration of the inner surface 306*a*, nor the aforementioned configuration of the outer surface 306*b*, is required.

With continued reference to the Figures, the restraint element 300 may further include a lip 308 that is connected to the upper edge of the wall 304 and extends inwardly, that is, in a direction toward where the tongue of the liner would be, from the wall 304. The lip 308 may have a depth and arc length adequate to ensure substantial contact between an underside 308*a* of the lip 308 and an upper edge of the tongue of a boot liner.

In more detail, the lip 308 may generally have the same curved shape as the wall 304, and the depth of the lip 308 may be approximately the same as the thickness of the tongue of a boot liner, although the depth of the lip 308 could be greater, or less, than the thickness of the tongue of the boot liner. Similarly, the arc length of the lip 308 may be approximately the same as the arc length of the upper edge of the tongue of the boot liner, although the arc length of the lip 308 could be greater, or less, than the arc length of the upper edge of the tongue of the boot liner. Finally, the depth of the lip 308 may vary at different locations. For example, as shown in the Figures, the lip 308 may be relatively deeper at its center than at its edges, which can each taper down to a respective connection point 306. That is, the depth of the lip 308 can decrease over a portion of the lip 308.

As explained then, the wall 304 and lip 308 cooperate such that the restraint element 300 is able to make substantial contact with the tongue of a boot liner in both the Z-axis direction and the X-axis direction, and also in the Y-axis direction. That is, the wall 304 and lip 308 collectively define an undercut area 310 configured to releasably accommodate part of the tongue 311 of a boot liner, and more particularly, an upper portion of the tongue of a boot liner, as shown in the cross-section view of FIG. 3*g*. The wall 304 and lip 308 thus collectively comprise what may be referred to herein as an engagement portion of the restraint element 300.

Figure 3A:
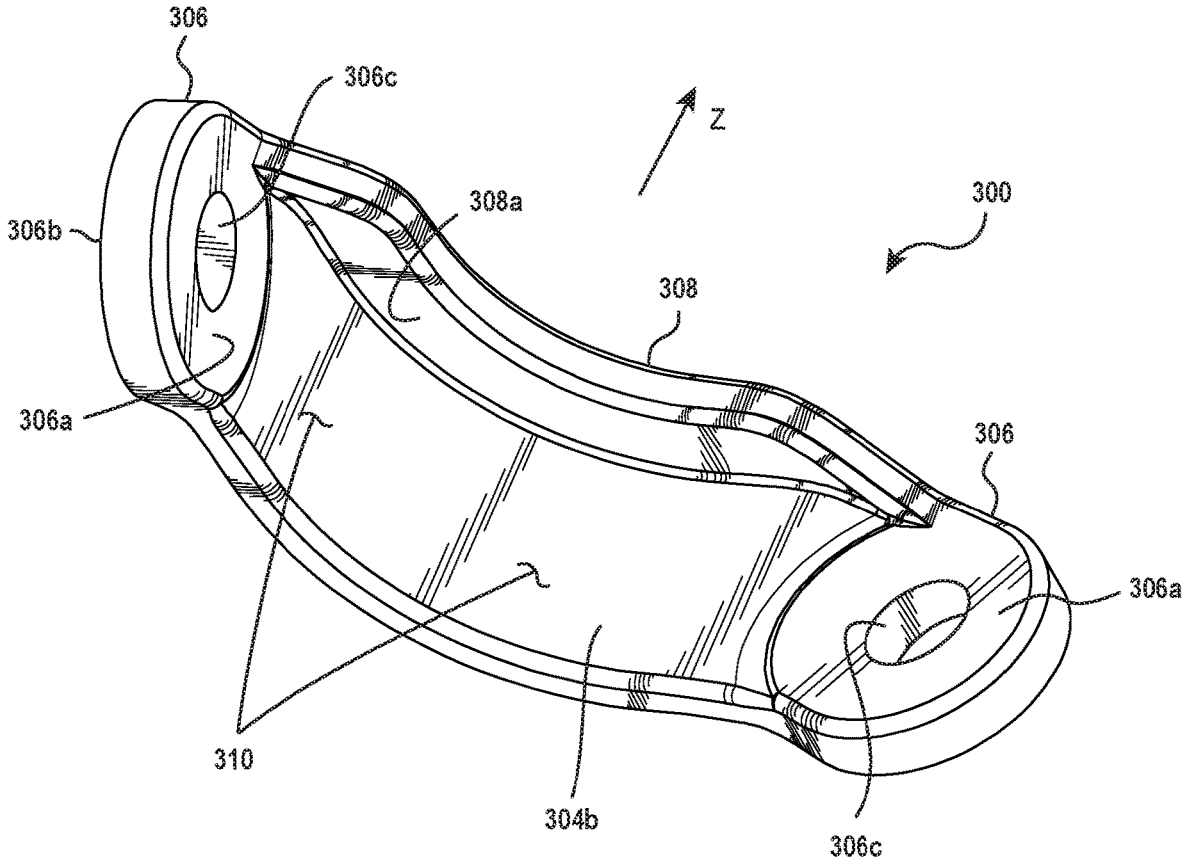
FIG. 3*a* is a bottom perspective view of an example embodiment of a restraint element.
Figure 3B:
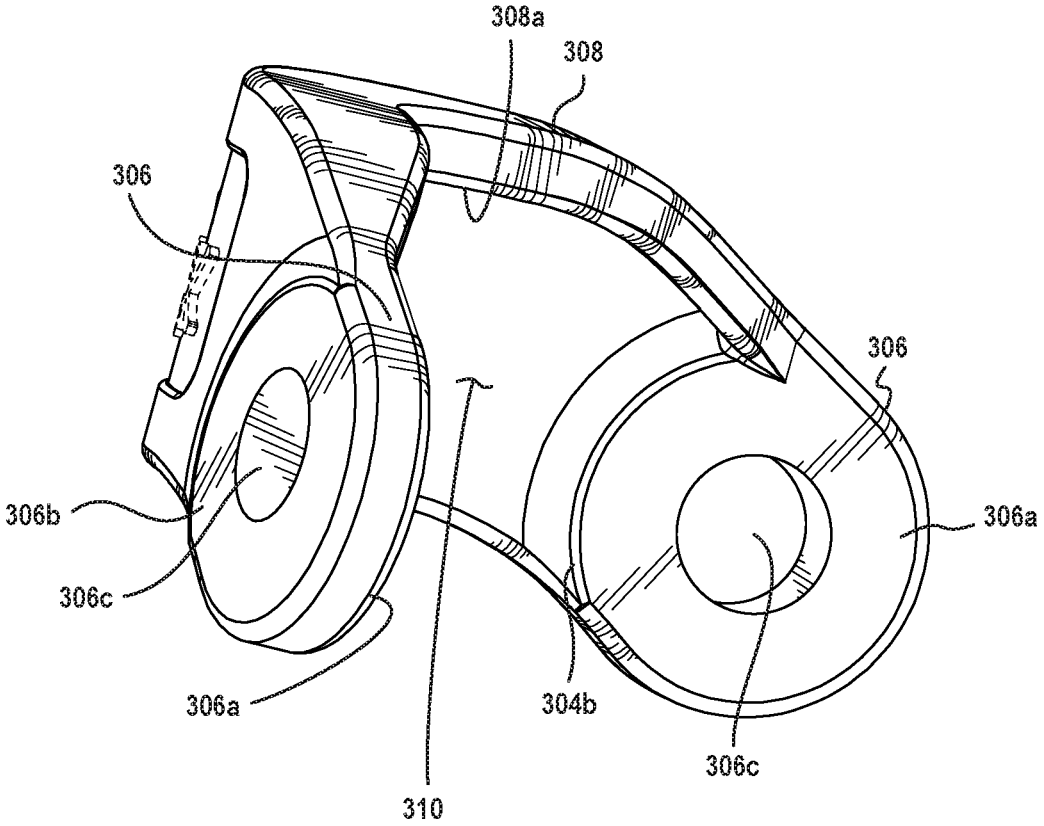
FIG. 3*b* is a rear perspective view of an example embodiment of a restraint element.
Figure 3C:
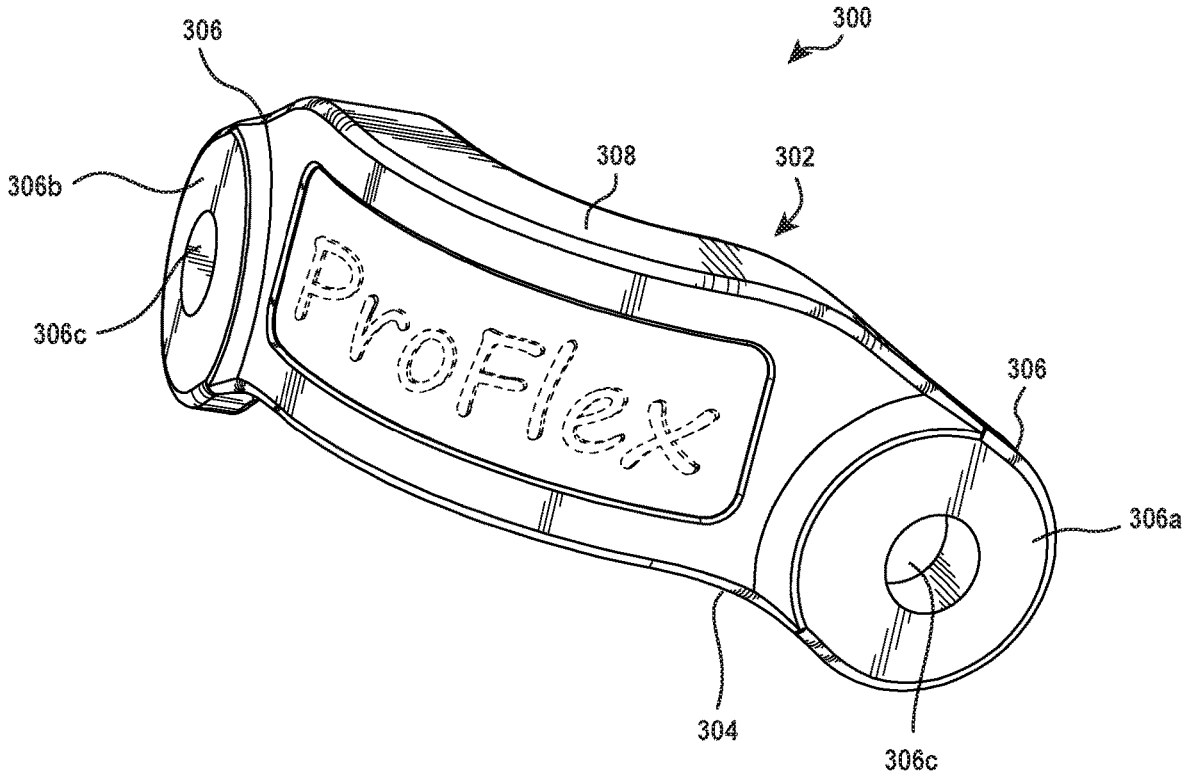
FIG. 3*c* is a front perspective view of an example embodiment of a restraint element.
Figure 3D:
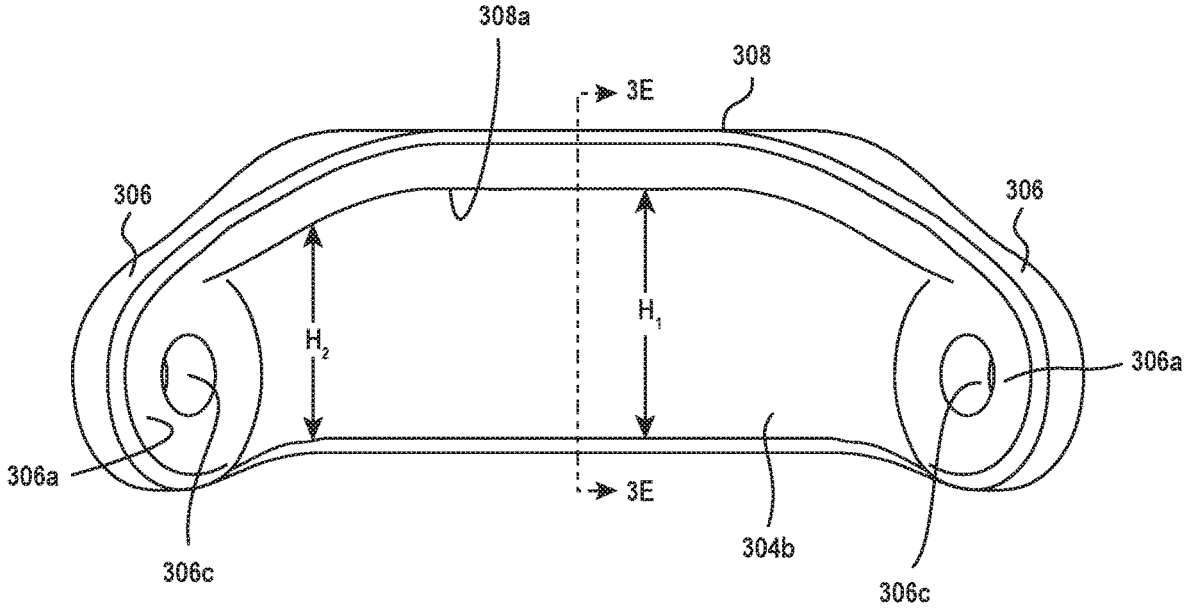
FIG. 3*d* is a rear view of an example embodiment of a restraint element.
Figure 3E:
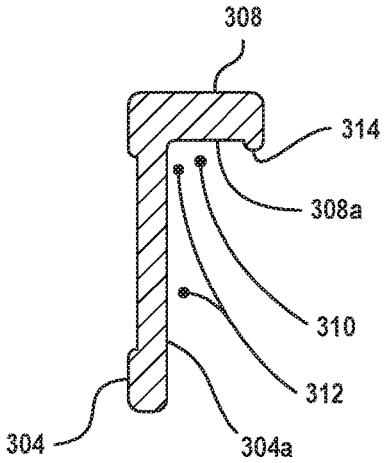
FIG. 3*e* is a section view of an example embodiment of a restraint element.
Figure 3F:
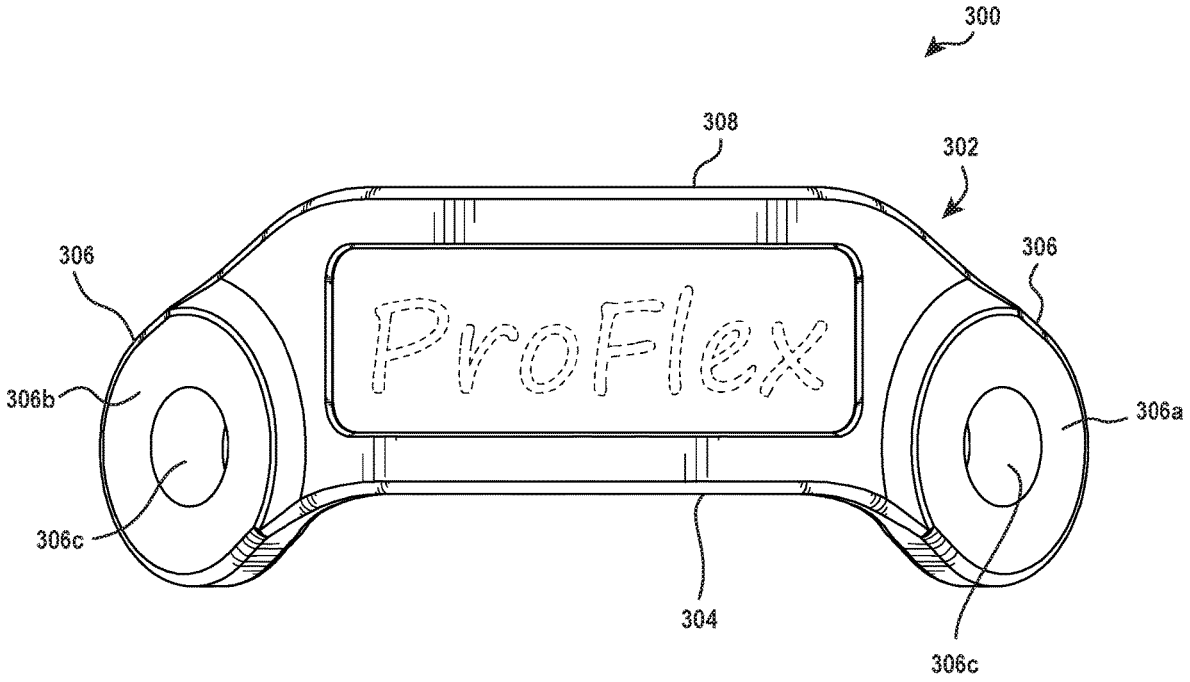
FIG. 3*f* is a front view of an example embodiment of a restraint element.
Figure 3G:
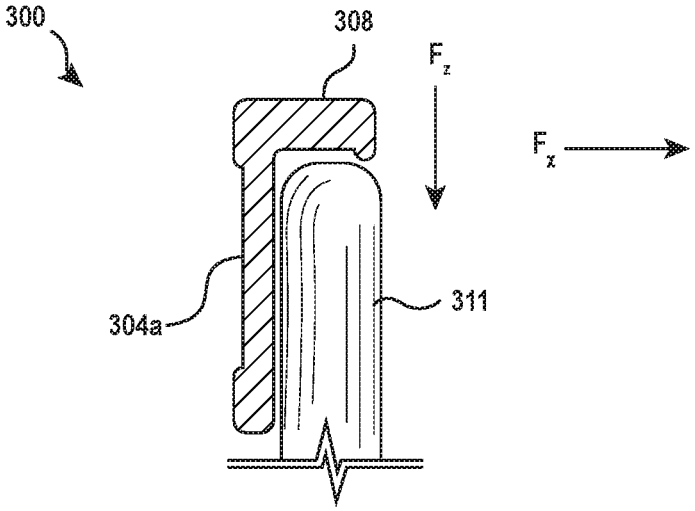
FIG. 3*g* is a section view of an example embodiment of a restraint element, showing an interface between a tongue of a boot liner and the restraint element.

With continued reference to the cross-section view of FIG. 3*e*, the restraint element 300 can further include a retention element 314 located at an edge of the lip 308 and extending downward into the undercut area 310. The retention element 314 can help to control movement of the boot tongue, such as by retaining the boot tongue in position relative to the restraint element 300. Retention and control of the boot tongue can also be aided by constructing the restraint element with materials having a relatively high coefficient of friction, such as silicon rubber for example, as noted elsewhere herein. In the illustrated example, the retention element has a cross-section generally in the shape of a half circle, although other configurations could be used, and additional retention elements could be provided.

Figure 3H:
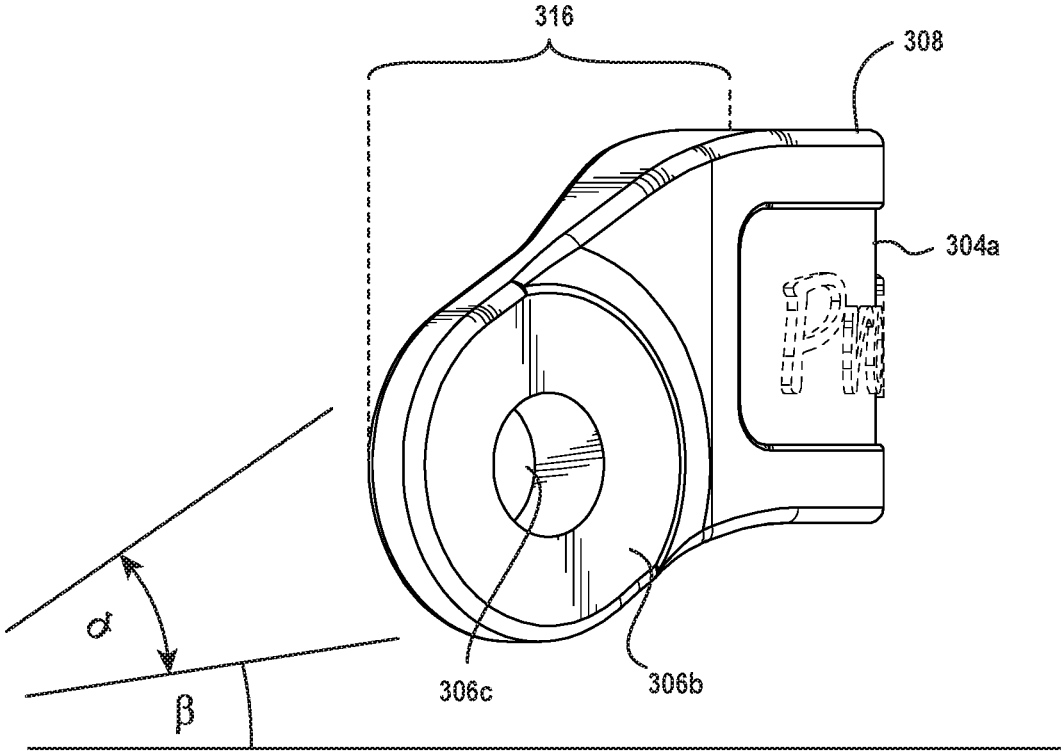
FIG. 3*h* is a side view of an example embodiment of a restraint element.
Figure 3I:
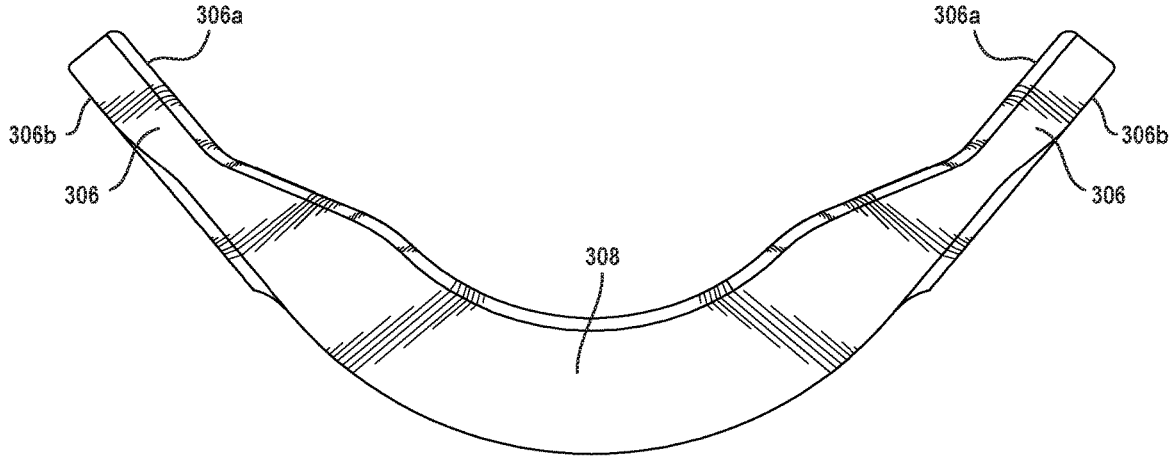
FIG. 3*i* is a top view of an example embodiment of a restraint element.

As further indicated in the Figures, particularly the side view of FIG. 3*h*, at least some embodiments of the restraint element, such as restraint element 300, include a downwardly extending wing portion 316 on either side. As shown, the wing portion 316 can include part of the lip 308 and wall 304, as well as the connection point 306. In some embodiments, the wing portion 316 can have an angle $\alpha$ in a range of about 25 degrees and about 35 degrees, although larger or smaller angles $\alpha$ could be used. Further, the wing portion 316 itself can be disposed at various angles $\beta$ relative to horizontal. In some embodiments, the angle $\beta$ can be in a range of about 15 degrees to about 25 degrees, although larger or smaller angles $\beta$ could be used.

Among other things, the angled geometry (angle $\alpha$) of the wing portion 316 and/or the orientation (angle $\beta$) of the wing portion 316, can help to ensure that when a band, such as band 204 for example, is positioned around the ski boot and connected to the connection points 316, the band can pull the restraint element 300 downward, as well as rearward, thus aiding in retention of the tongue of the boot liner. This functionality may be provided both when the band is oriented substantially horizontally, and when the band is disposed at the angle $\beta$.

Figure 3J:
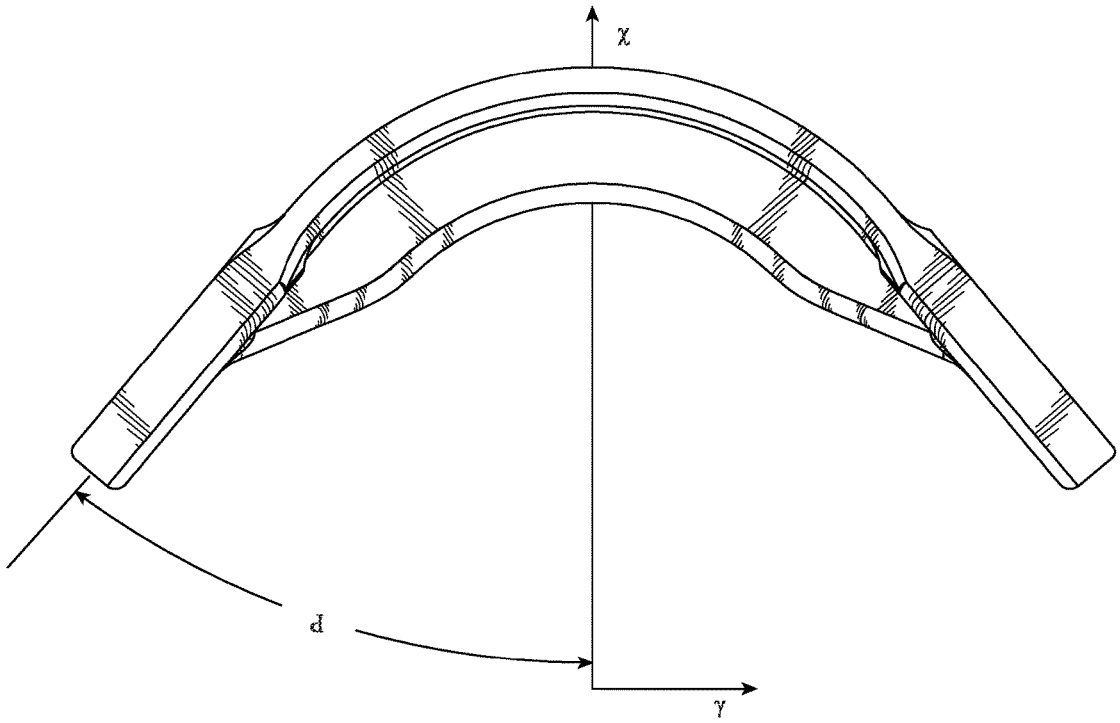
FIG. 3*j* is a side view of an example embodiment of a restraint element.
Figure 4A:
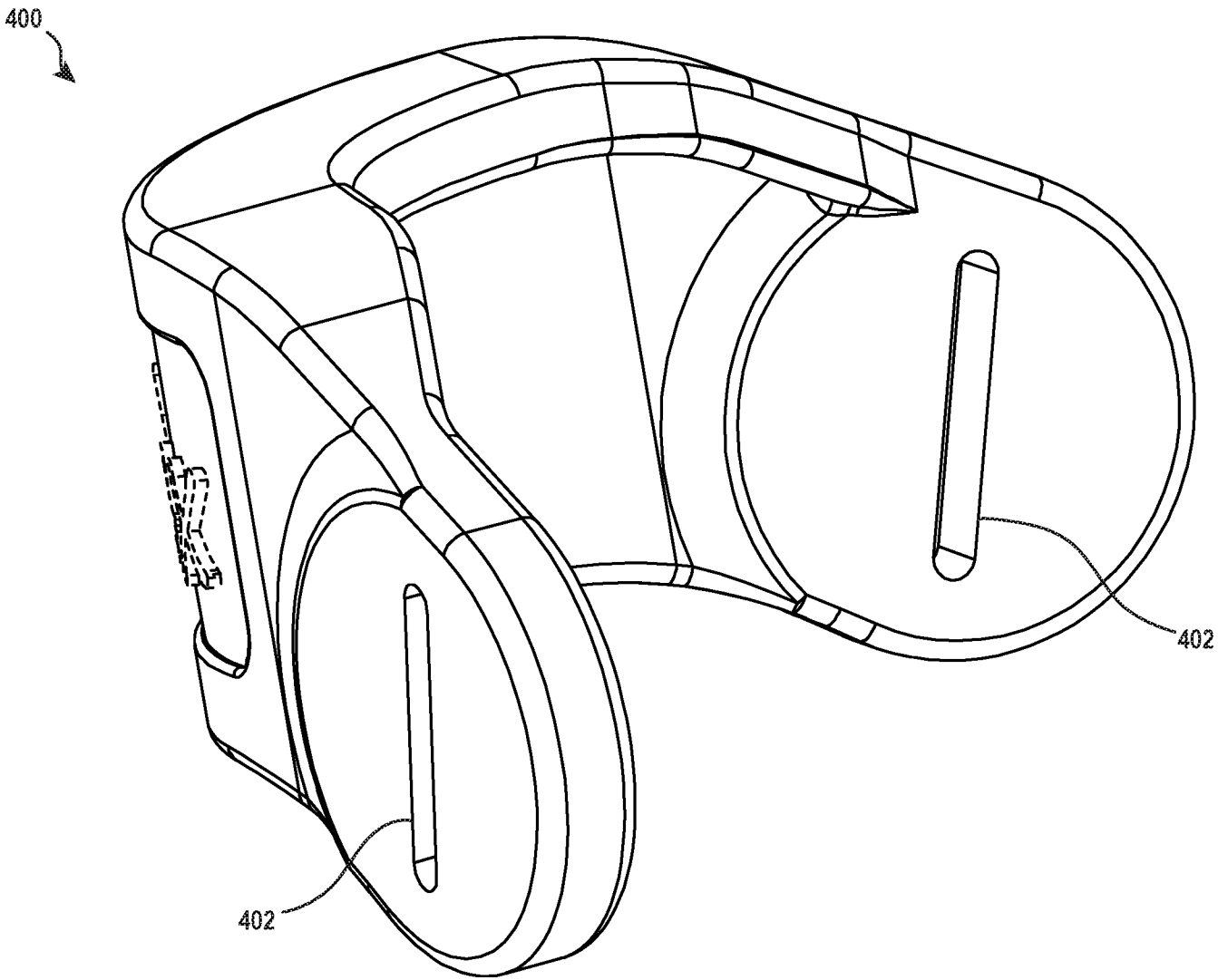
FIG. 4*a* is a top perspective view of another embodiment of a restraint element for a ski boot liner.
Figure 4B:
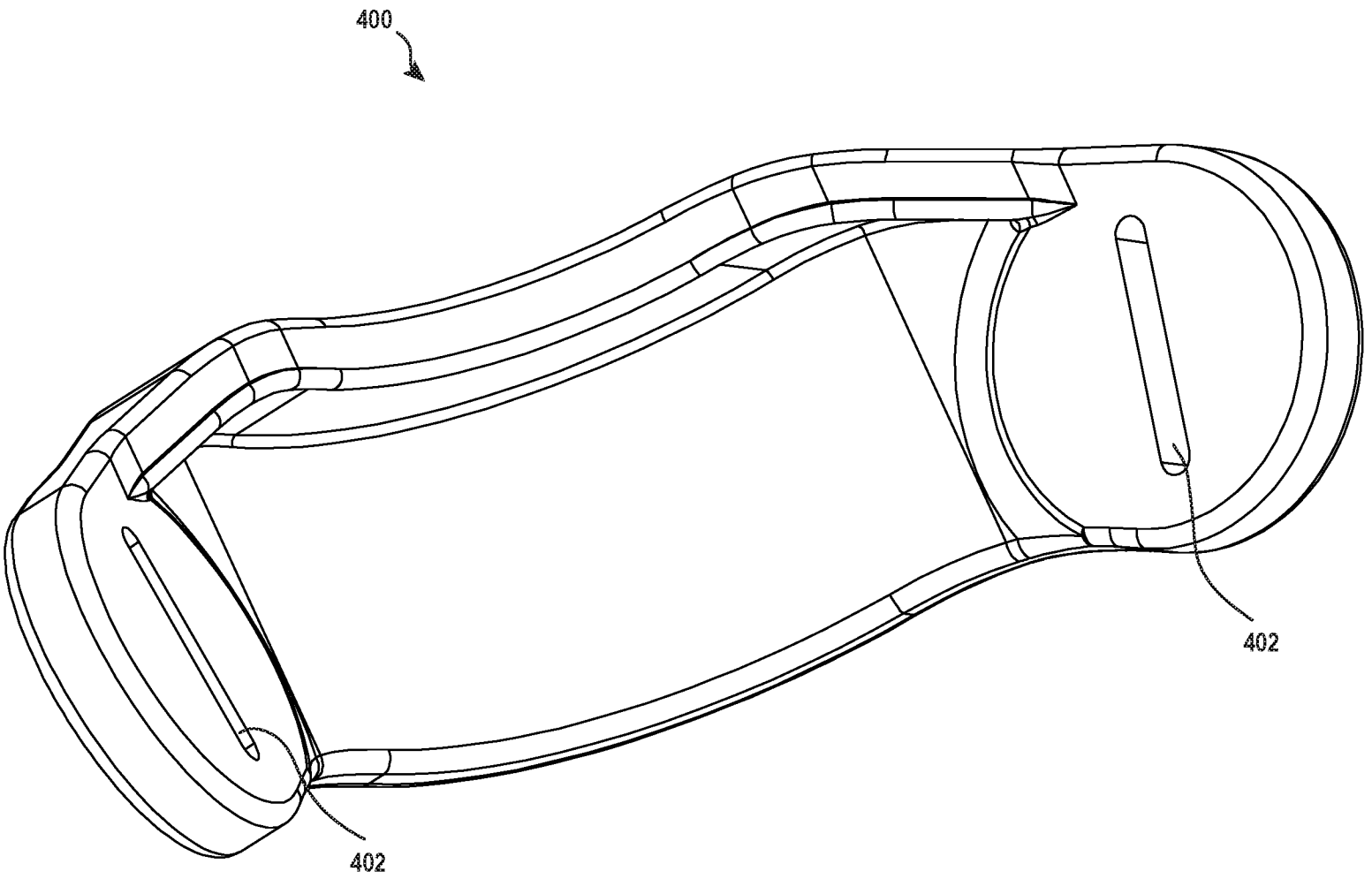
FIG. 4*b* is a bottom perspective view of the restraint element for the ski boot liner of FIG. 4*a;*
Figure 4C:
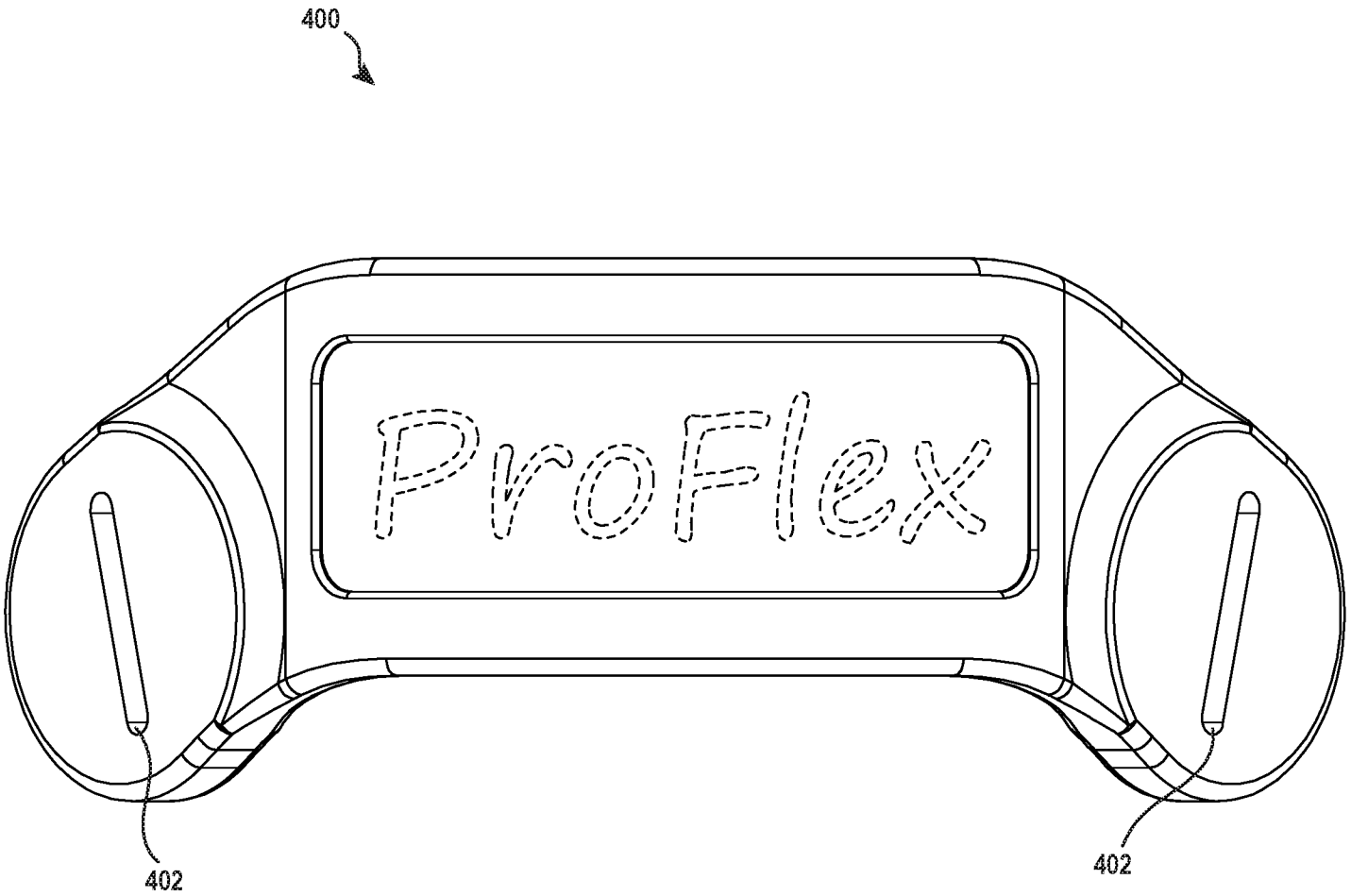
FIG. 4*c* is a front view of the restraint element for the ski boot liner of FIG. 4*a;*
Figure 4D:
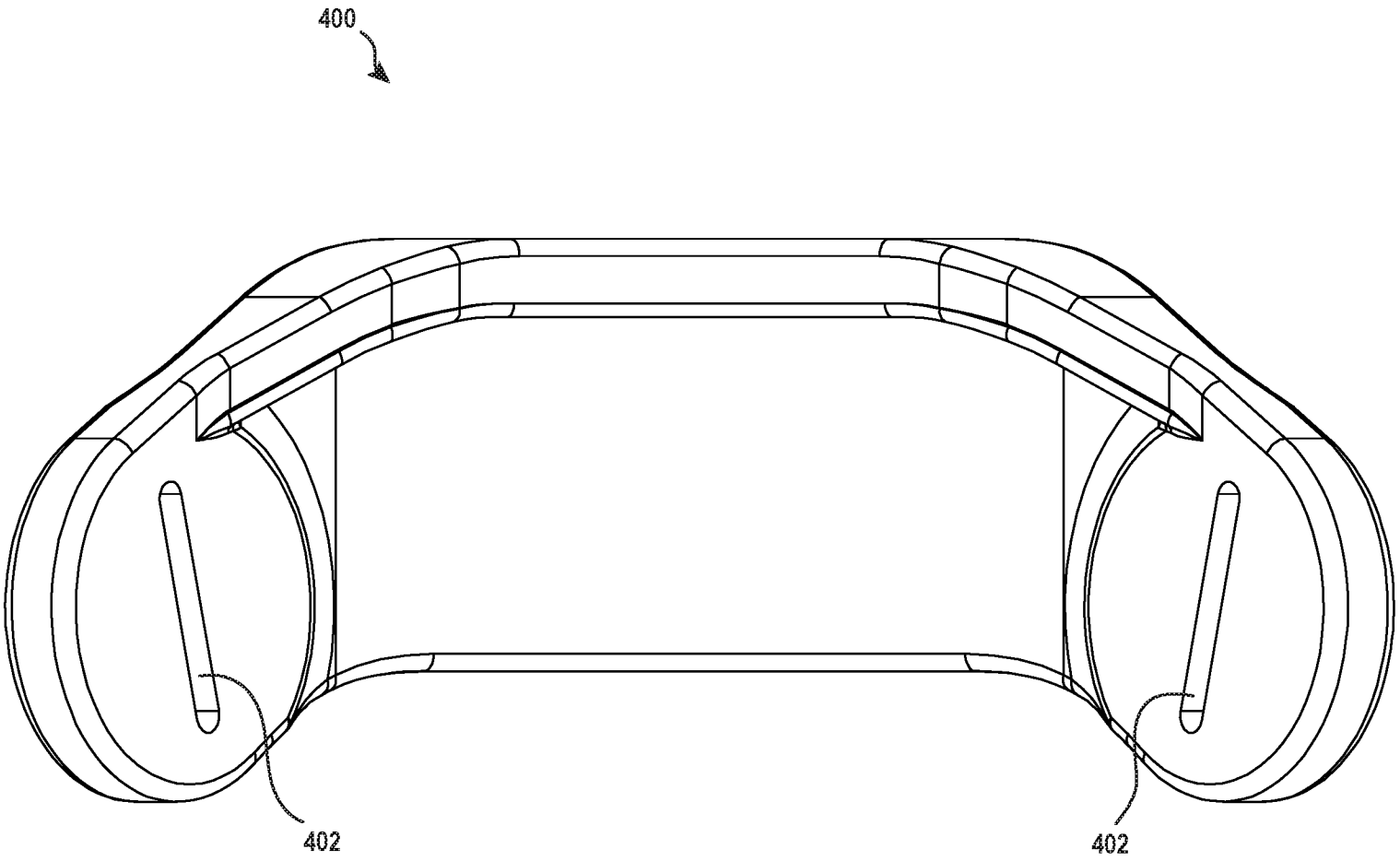
FIG. 4*d* is a back view of the restraint element for the ski boot liner of FIG. 4*a;*
Figure 4E:
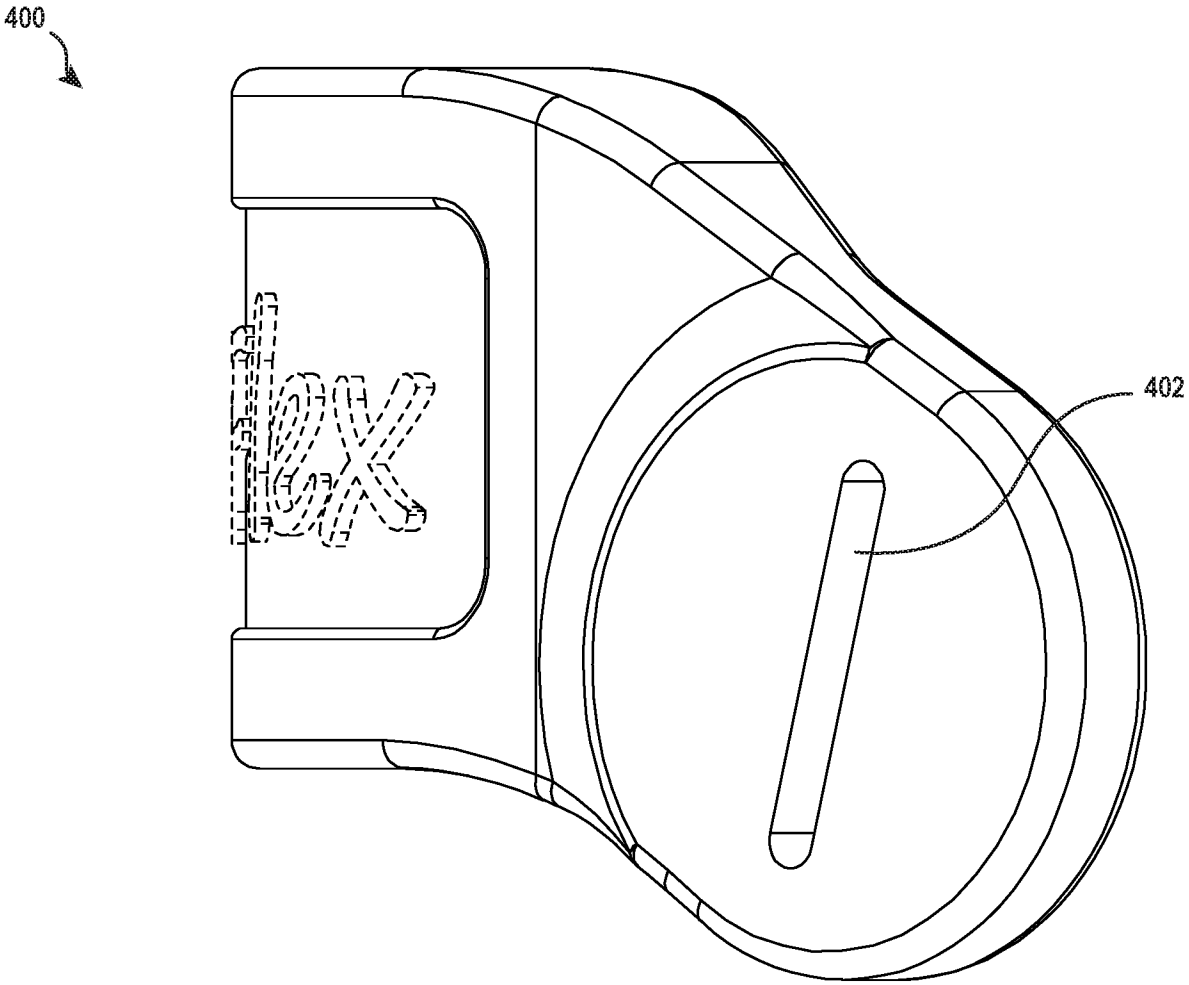
FIG. 4*e* is a left side view of the restraint element for the ski boot liner of FIG. 4*a;*
Figure 4F:
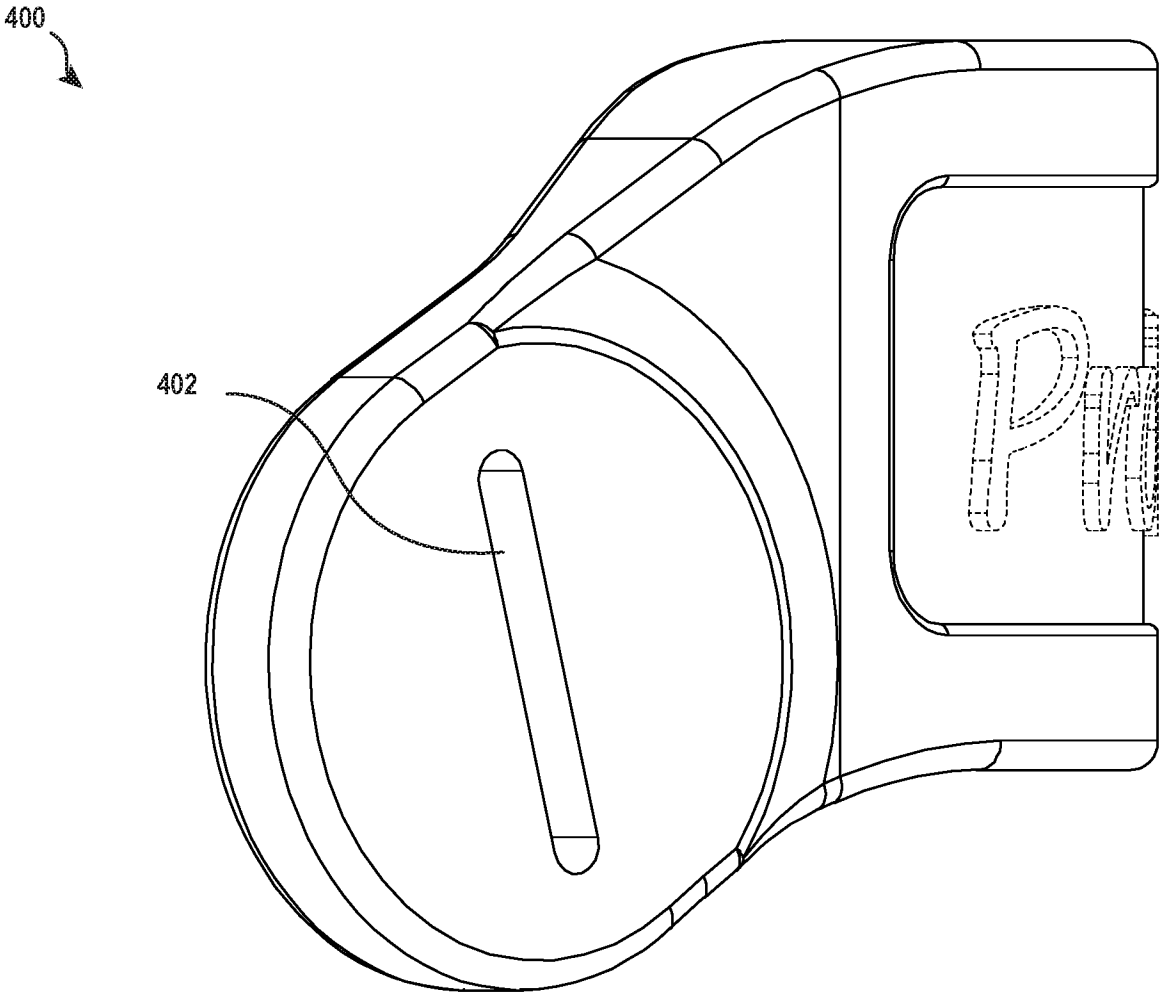
FIG. 4*f* is a right side view of the restraint element for the ski boot liner of FIG. 4*a;*
Figure 4G:
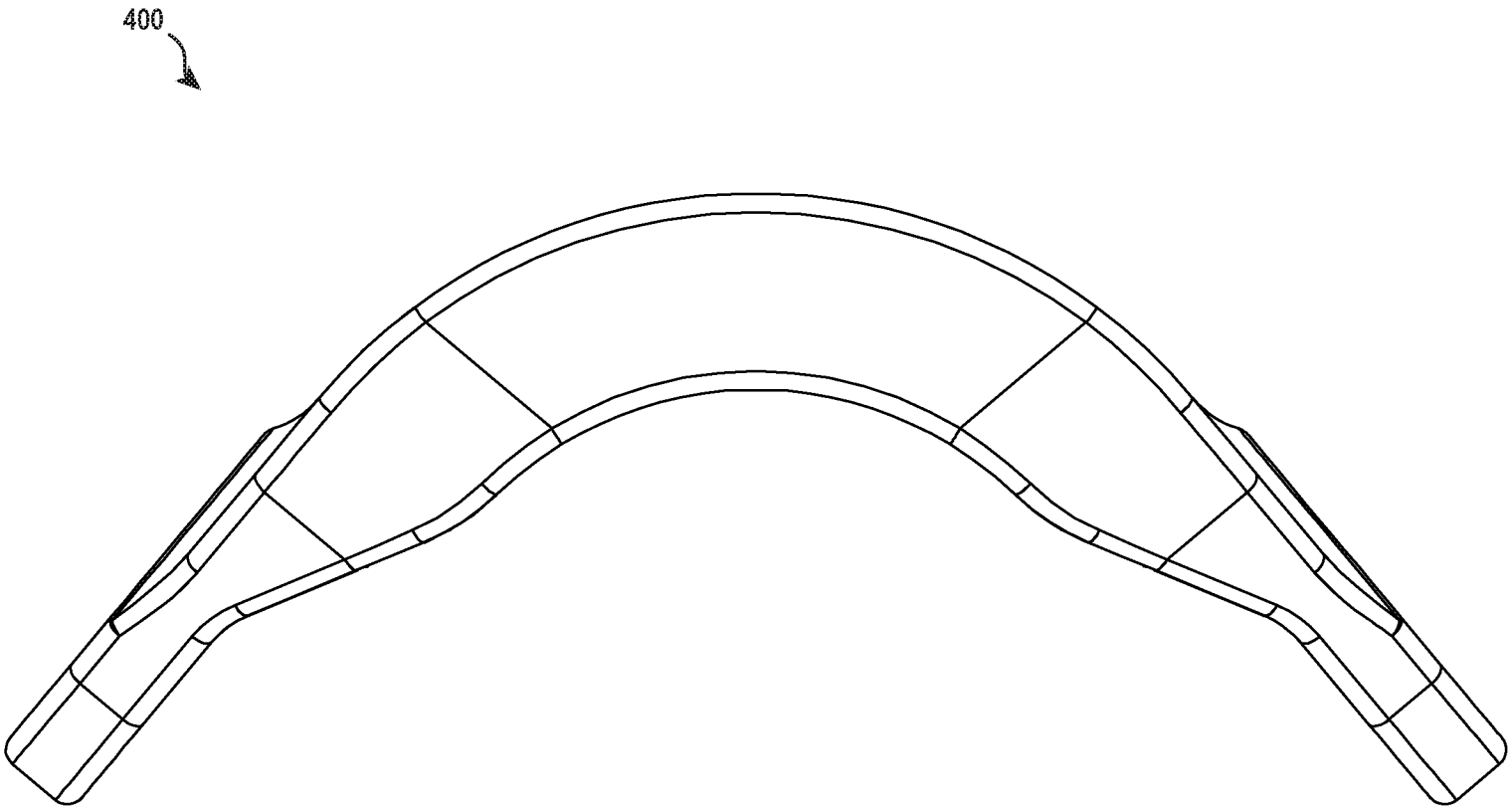
FIG. 4*g* is a top view of the restraint element for the ski boot liner of FIG. 4*a;*
Figure 4H:
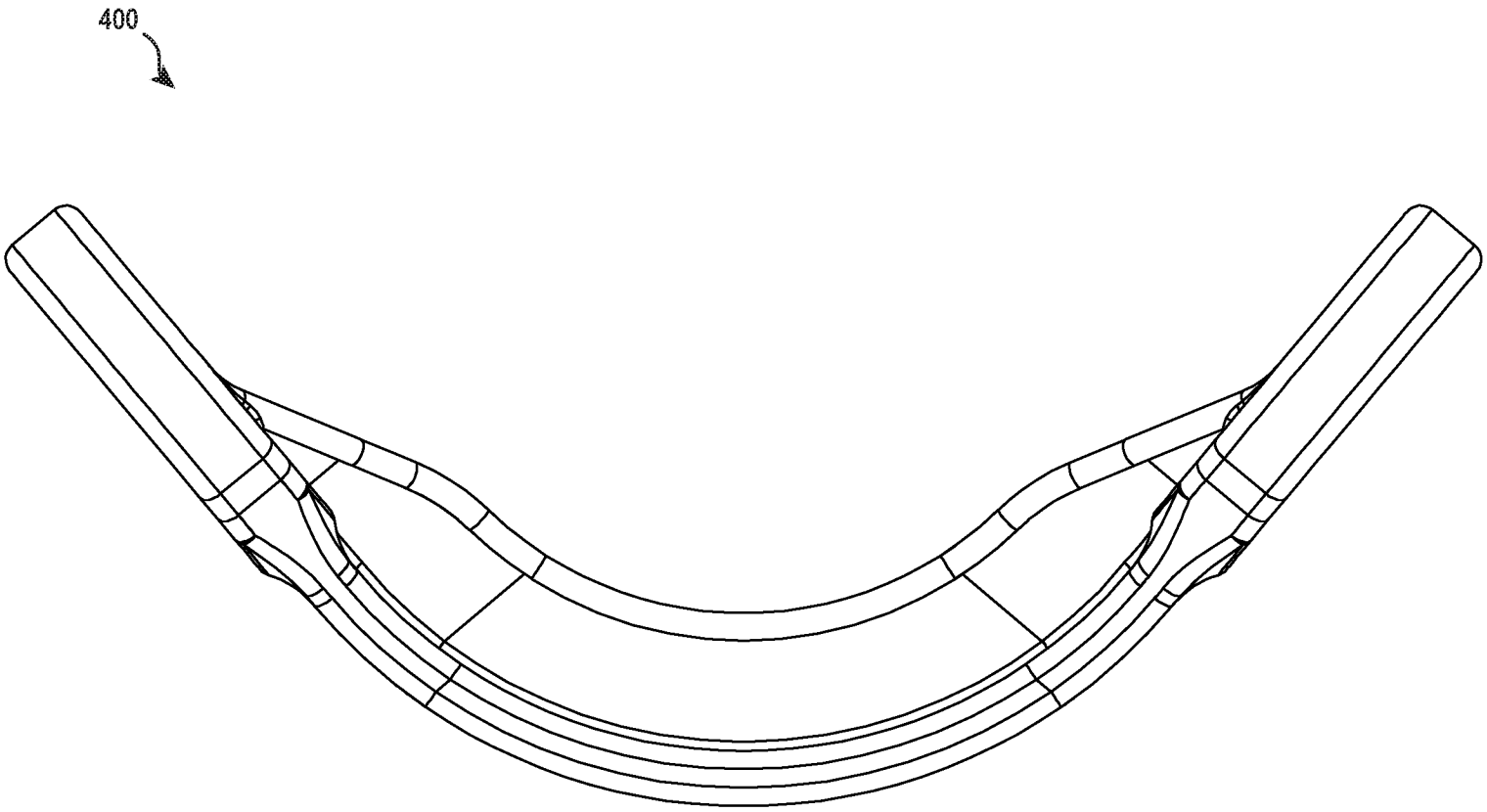
FIG. 4*h* is a bottom view of the restraint element for the ski boot liner of FIG. 4*a*.

The wing portions 316 can also be disposed at an angle $\delta$ relative to the X-axis in the X-Y plane, as shown in the bottom view disclosed in FIG. 3*j*. In some embodiments, the angle $\delta$ can be in a range of about 40 degrees to about 50 degrees. In still other embodiments, the angle $\delta$ may be less than about 40 degrees, or greater than about 50 degrees. The scope of the invention is not limited to any particular configuration however. In general, the angle $\delta$ can be varied from one embodiment to another, such as to accommodate different boot and/or liner sizes and/or geometries.

With continued attention to the Figures, some example dimensions (in millimeters) of a cross-section of a portion of the restraint element 300 are shown in FIG. 3*e*, however, the scope of the invention is not limited to any particular size of the restraint element 300 or any particular size of the constituent portions of the restraint element 300. As such, the dimensions shown in the Figures are provided only by way of example.

Directing attention now to FIGS. 4*a*-4*h*, details are provided concerning one alternative embodiment of a retention element for a ski boot liner, where the retention element is denoted generally at 400. The retention element 400 may be similar, or identical, to other embodiments disclosed herein, except as noted below.

In particular, the retention element 400 includes a pair of slots 402 configured to receive, for example, a band (not shown) that may be similar to band 204. In at least some embodiments, each end of the band may pass through a respective slot 402 and double back and be attached to itself, such as by way of a snap or other attachment mechanism. The portion of the band between the two ends can be removably or permanently attached to a shell of a ski boot, or other footwear, using any of the example fasteners disclosed herein, or other fasteners.

In another embodiment, each end of the band may pass through a respective slot 402 and double back and be permanently attached to itself, such as by way of stitching and/or adhesive for example. A band used in connection with the slots 402 can also include both elastic and inelastic portions. The portion of the band between the two ends can be removably or permanently attached to a shell of a ski boot, or other footwear, using any of the example fasteners disclosed herein, or other fasteners.

With continued reference to the Figures, the dimensions of the slots 402, including the height and width, can be selected as necessary, and the scope of the invention is not limited to any particular slot 402 geometry. Similarly, while the slots 402 shown in the Figures are in a generally vertical orientation, or tilted slightly toward the rear of the retention element 400, the slots 402 can be oriented in any other direction, and the scope of the invention is not limited to what is shown in the Figures.

Finally, edges and corners of the slots 402 can be radiused or filleted, as applicable, to eliminate any edges that might otherwise be vulnerable to breakage or wearing. This approach can also be taken with regard to the openings 306*c* disclosed elsewhere herein.

Figure 5A:
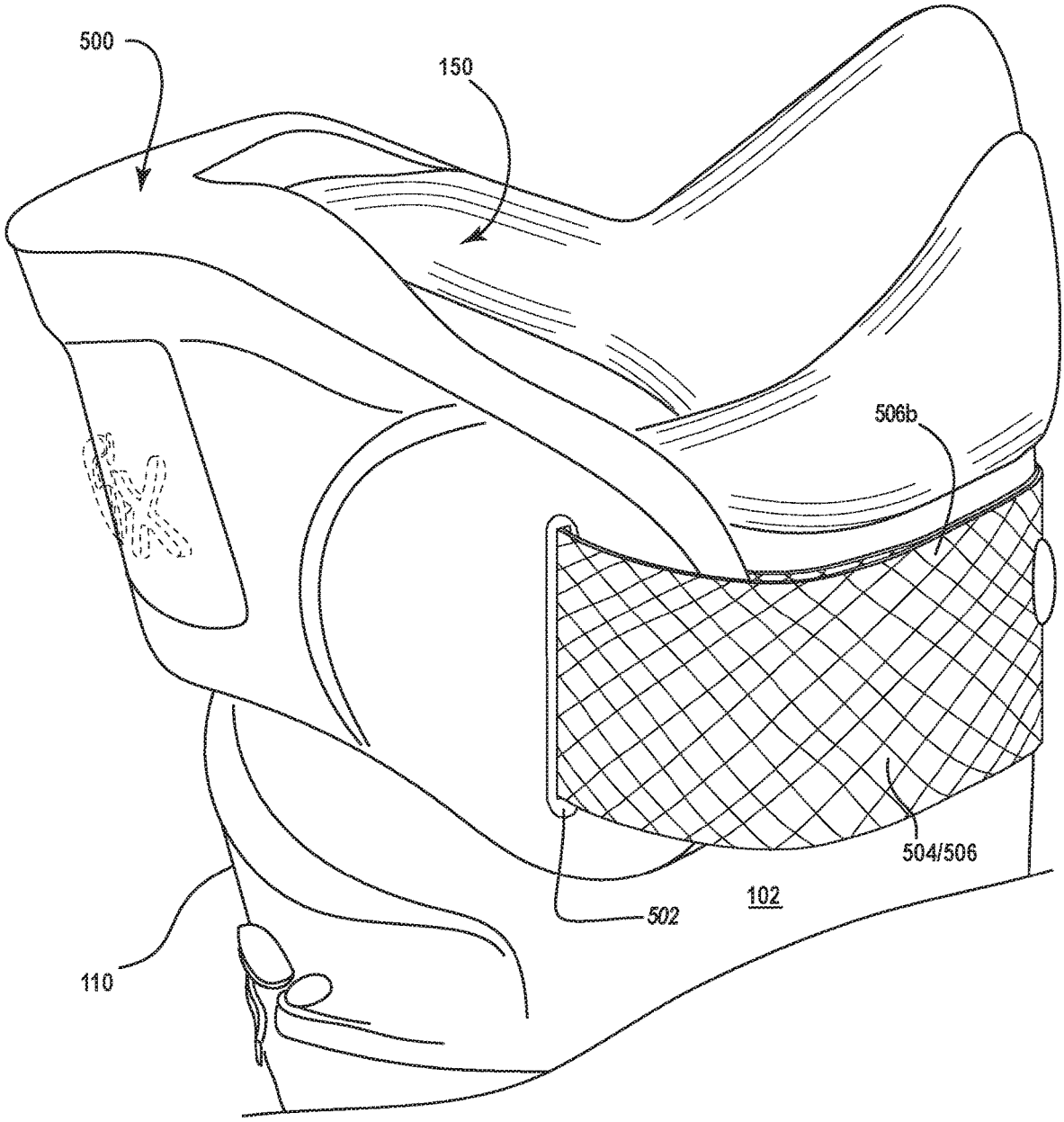
FIGS. 5*a*, 5*b* and 5*c* are directed to another example embodiment of restraint element.
Figure 5B:
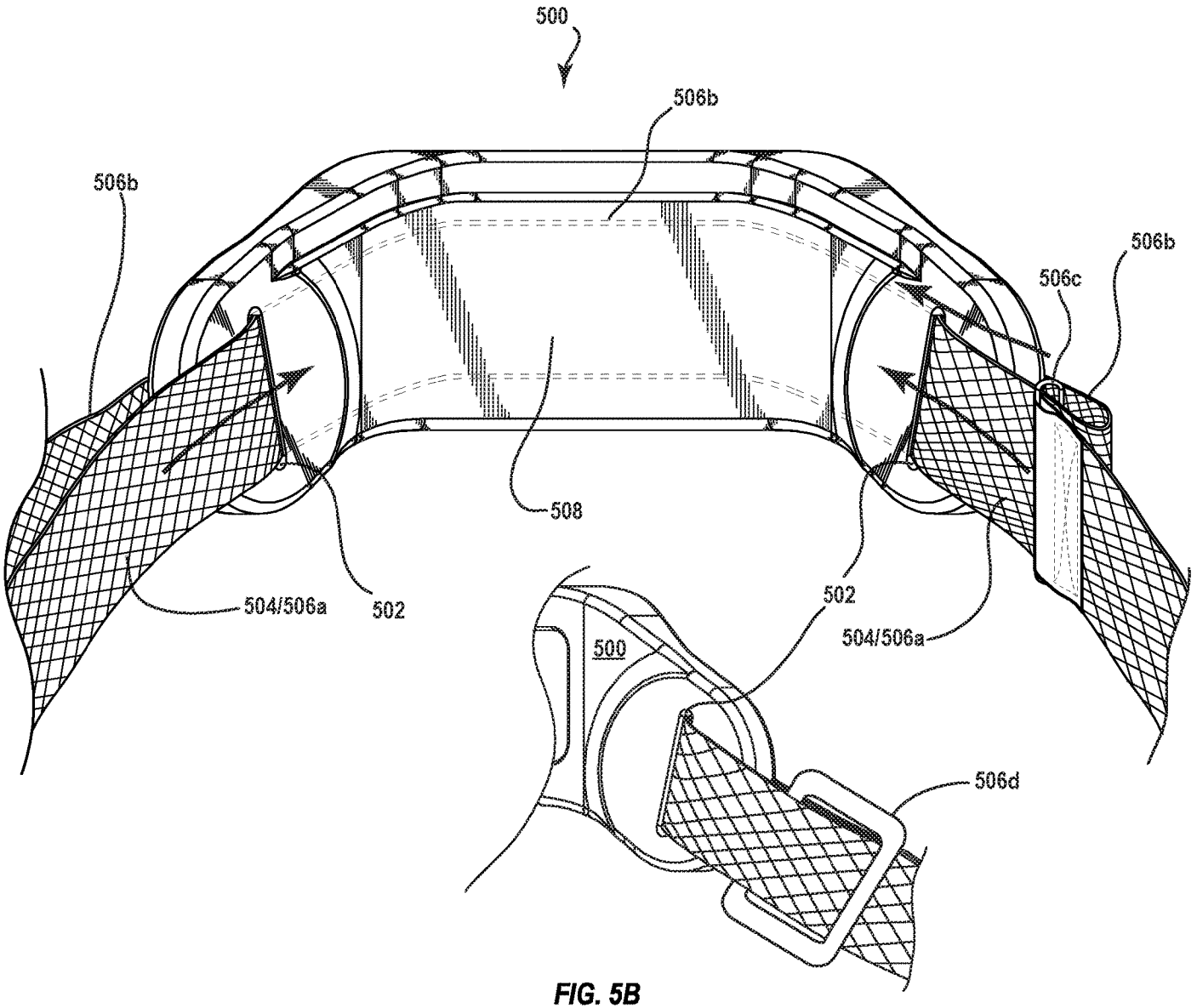
Figure 5C:
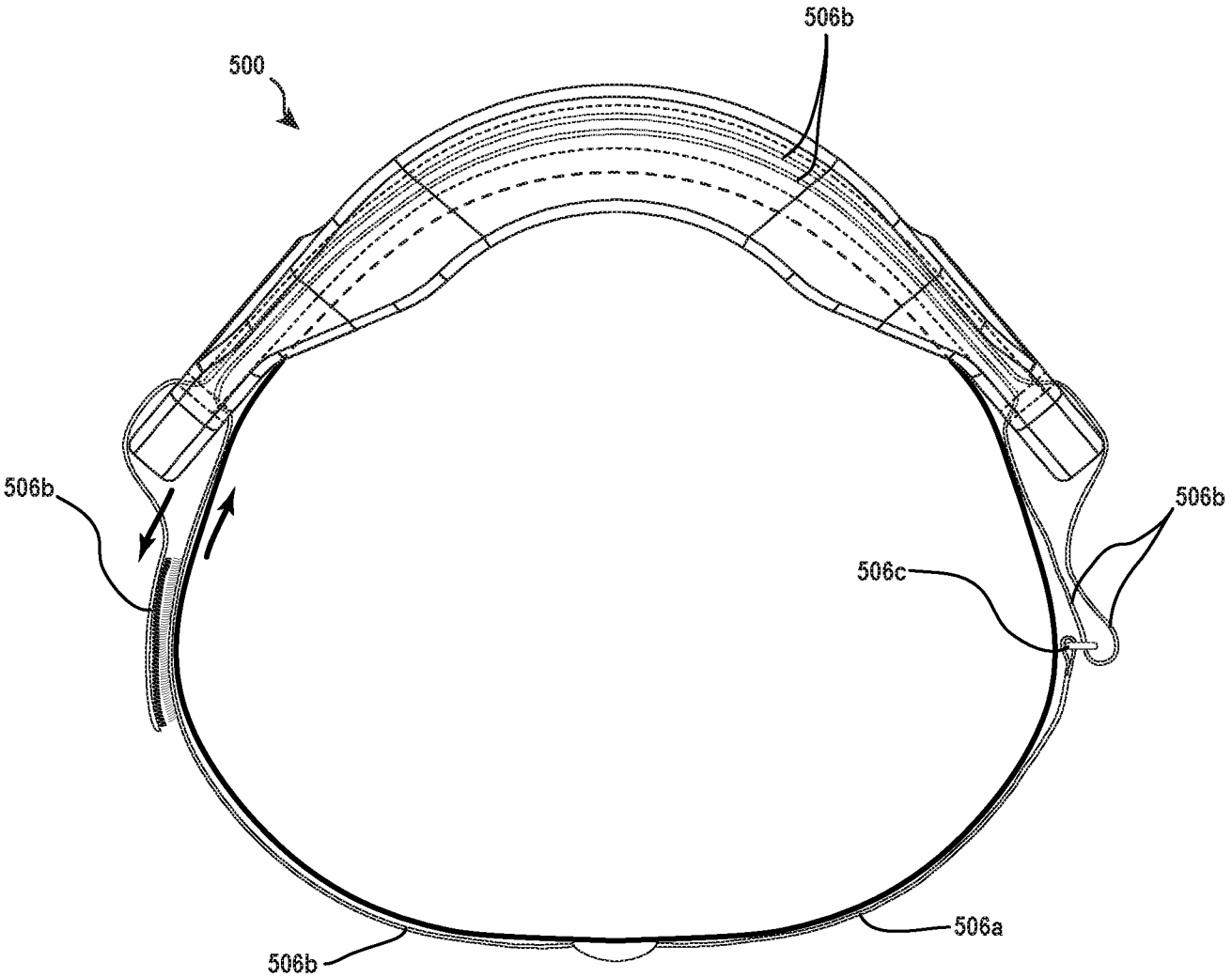

With attention now to FIGS. 5*a*, 5*b* and 5*c*, details are provided concerning an alternative embodiment of a restraint element 500. In terms of the material(s) with which it is made, and its functionality, the restraint element 500 can be similar, or identical, to any other embodiment of a restraint element disclosed herein.

Directing particular attention now to FIG. 5*a*, the restraint element 500 can be similar or identical in its overall construction, such as its size and shape, to the restraint element 300 disclosed in FIG. 3*a*, except that the openings 306*c* of the restraint element 300 are replaced with slots 502 in the restraint element 500. In general, and as shown in FIG. 5*a*, the slots 502 are sized and configured to enable a band 504 to pass through. In terms of its material and construction, the band 504 may be similar or identical to any other disclosed embodiment of a band, including the band 204 for example.

In at least some embodiments, the band 504 takes the form of so-called 'power strap' 506 found on some types of ski boots. As such, the embodiment disclosed in FIGS. 5*a* and 5*b* need not employ a separate band, but can be employed with an existing power strap 506 of a ski boot. As shown in FIG. 5*a*, the power strap 506 may be attached to the shell 102, particularly the upper portion of the rear cuff for example, with a rivet, pin or other fastener(s). Thus, a user can readily employ the restraint element 500 without any modifications to his ski boot or other footwear with which the restraint element 500 is to be employed. It should be noted here that the restraint element 400 of FIGS. 4*a*-4*h* may also be employed with an existing power strap of a ski boot by passing the power strap through the slots 402 and cinching the power strap using a mechanism such as is disclosed in FIG. 5*b*, discussed below.

Although the restraint element 500 may be used with an existing power strap of a ski boot, or other footwear, the restraint element 500 is positioned in the same way, and performs the same functions, as the other restraint element embodiments disclosed herein. For example, and as is the case with such other embodiments, the restraint element 500 can engage with the ski boot tongue and/or ski boot shell.

With continued attention to FIG. 5*a*, and directing attention now to FIGS. 5*b* and 5*c* as well, further details are provided concerning the configuration and use of the restraint element 500. It was noted earlier that the restraint element 500 includes two slots 502, one at either side of the restraint element 500. As further indicated in FIG. 5*b*, the restraint element 500 defines an internal sleeve 508 that communicates with the slots 502 so as to enable the power strap 506 to pass through a first one of the slots 502 into one side of the body of the restraint element 500, through the body of the restraint element 500, and out the other side of the body of the restraint element 500 through a second one of the slots 502, as shown.

This arrangement enables secure positioning of the restraint element 500, and the silicone rubber body of the restraint element 500 helps to minimize slippage or other movement of the power strap 506 relative to the restraint element 500. As a result, the restraint element 500 can be reliably secured in place, and its position maintained notwithstanding significant movements of the ski boot.

As best shown in FIG. 5*c*, and with continued attention to FIGS. 5*a* and 5*b*, the power strap 506 may include a cinch portion 506*a* and an adjustment portion 506*b*. The cinch portion 506*a* and adjustment portion 506*b* can be two parts of the same power strap, or can be separate elements that are each attached to the cuff 110 of the ski boot. The cinch portion 506*a* may terminate in a cinch mechanism 506*c*, which can simply be an elongate metal loop as shown in FIG. 5*b*. Alternatively, the cinch portion 506*a* may terminate in a cinch mechanism 506*d*, which can a spring-loaded cleat. More generally, the cinch mechanism can be any mechanical device which enables a user to tighten the power strap 506, and the scope of the invention is not limited to the disclosed examples of a cinch mechanism.

With continued reference to FIG. 5*c*, which shows a top view of a ski boot, it can be seen that the adjustment portion 506*b*, which may be substantially longer than the cinch portion 506*a*, can first be passed in a clockwise direction through the restraint element 500 by way of the internal sleeve 508. The end of the adjustment portion 506*b*, still extending in a clockwise direction, can then be passed through the cinch mechanism 506*c* and returned, now in a counterclockwise direction back through the restraint element 500 by way of the internal sleeve 508. The free end of the adjustment portion 506*b* which may include a hook-and-loop fastener such as Velcro®, or any other releasable fastener, can then be pulled to the desired tightness and secured. As with other embodiments of a band disclosed herein, the power strap 506 can include an elastic portion, although that is not required.

As will be apparent from the discussion of FIGS. 5*a*-5*c*, some embodiments of the invention are well suited for use with an existing power strap of a ski boot, snowboard boot, telemark ski boot, or other footwear. Advantageously, this configuration can be employed without compromising the functionality of the restraint element.

The present invention may be embodied in other specific forms without departing from its spirit or essential characteristics. The described embodiments are to be considered in all respects only as illustrative and not restrictive. All changes which come within the meaning and range of equivalency of the claims are to be embraced within their scope.

What is claimed is:

1. A ski boot, comprising:

a plastic shell;

a boot liner partly received within the plastic shell, and the boot liner including a tongue having an upper edge; and a dynamic support strap, comprising:

a band connected to the plastic shell; and a restraint element connected to the band, the restraint element comprising a wall and a lip that together define an undercut area behind the wall, and the undercut area is configured and arranged to receive a portion of the upper edge of the tongue when the restraint element is operably positioned with respect to the tongue.

2. The ski boot as recited in claim 1, wherein the restraint element has a unified single piece construction.

3. The ski boot as recited in claim 1, wherein the restraint element comprises plastic and/or rubber.

4. The ski boot as recited in claim 1, wherein a depth of the lip varies such that the lip is deeper in a middle portion of the lip than in either of two side portions of the lip.

5. The ski boot as recited in claim 1, wherein the restraint element further comprises a retention element located near a rearmost edge of the lip.

6. The ski boot as recited in claim 1, wherein the restraint element further comprises a first wing disposed on a first side of the restraint element, and a second wing disposed on a second side of the restraint element.

7. The ski boot as recited in claim 6, wherein a height of the wall is greater at a middle portion of the restraint element than at the first wing and the second wing.

8. The ski boot as recited in claim 6, wherein a first portion of the undercut area terminates in the first wing, and a second portion of the undercut area terminates in the second wing.

9. The ski boot as recited in claim 6, wherein each of the first wing and the second wing extends: in a downward z-axis direction; in an outward y-axis direction; and, in a rearward x-axis direction.

10. The ski boot as recited in claim 1, wherein when the restraint element is operably positioned with respect to the tongue, part of the restraint element is positioned behind, and/or above, a cuff of the plastic shell.

11. The ski boot as recited in claim 1, wherein the restraint element is configured such that a convex front surface of the wall faces in a direction toward a toe portion of the plastic shell, and a concave rear surface of the wall faces in a direction toward a heel portion of the plastic shell.

* * * * *